United States Patent [19]

Kume et al.

[11] Patent Number: 5,057,403

[45] Date of Patent: Oct. 15, 1991

[54] PACKAGER OF PHOTOSENSITIVE MATERIAL

[75] Inventors: Yuuji Kume; Shinpei Ikenoue, both of Minami-ashigara, Japan

[73] Assignee: Fuji Photo Film Co., Ltd., Minami-ashigara, Japan

[21] Appl. No.: 461,391

[22] Filed: Jan. 5, 1990

[30] Foreign Application Priority Data

Jan. 6, 1989 [JP] Japan ..... 1-876

[51] Int. Cl.[5] ..... G03C 3/00

[52] U.S. Cl. ..... 430/496; 430/501; 430/531; 430/533; 430/627; 206/455

[58] Field of Search ..... 430/501, 531, 533, 627, 430/496; 242/71.1; 354/275; 206/389, 408, 409, 455

[56] References Cited

U.S. PATENT DOCUMENTS

| | | | |
|---|---|---|---|
| 2,303,173 | 11/1942 | Roehrl | 206/409 |
| 3,312,338 | 4/1967 | Uterhart | 206/408 |
| 3,490,578 | 1/1970 | Speakman | 206/409 |
| 4,597,658 | 7/1986 | Buelens et al. | 354/275 |
| 4,678,743 | 7/1987 | Yamada et al. | 430/551 |
| 4,783,396 | 11/1988 | Nakamura et al. | 430/353 |
| 4,928,826 | 5/1990 | Shibazaki et al. | 242/71.1 |

*Primary Examiner*—Charles L. Bowers, Jr.
*Assistant Examiner*—Janet C. Baxter
*Attorney, Agent, or Firm*—Burns, Doane, Swecker & Mathis

[57] ABSTRACT

A miniaturized package of a photosensitive material, which comprises a silver halide photosensitive material comprising a transparent synthetic resin support having at least one photosensitive silver halide emulsion layer formed thereon and a sealed container containing the photosenstive material, the support having a water content of 0.3 to 1.5% by weight and the content volume of the sealed container being 0.08 x $cm^3$ or less when the area of one surface of the photosensitive material is x $cm^2$. By this miniaturized package, the size and weight of camera can be reduced. The photographic properties of the photosensitive material contained in the package are not easily deteriorated.

11 Claims, 3 Drawing Sheets

PACKAGER OF PHOTOSENSITIVE MATERIAL

BACKGROUND OF THE INVENTION

The present invention relates to a package of a photosensitive material. In particular, the present invention relates to a package of a photosensitive material comprising a miniaturized sealed container containing a photosensitive material composed of a support having a water content of 1.5% by weight or less. The shelf-life of the photosensitive material in the package is equal to or longer than that of conventional photosensitive materials.

Recent improvements in silver halide photographic films and cameras have been accompanied by increased interest in high-quality photographic images. This has led to rising popularity for 35 mm single lens reflex cameras and 35 mm compact cameras.

The cameras using 35 mm roll film and the roll film itself are disadvantageous in that they are large in size and not handy to carry. Under these circumstances, miniaturized cameras such as the 110 camera and the disc camera were developed. However, since the exposed image area in these small cameras is smaller than that of a 35 mm camera, the quality of the image is inferior to that of conventional photographs. They are thus incompatible with the demand for high-quality images. As a result, these cameras have found little acceptance among users.

In order to reduce the size and weight of a camera without sacrificing the exposed image area, it is necessary to miniaturize only the cartridge while leaving the 35 mm film as it is. From the viewpoint of easy portability of the film, it is necessary to miniaturize not only the cartridge but also the closed cartridge case (patrone case; usually called "P case") for keeping the photosensitive material from surrounding harmful gas.

Through investigations concerning the miniaturization of the cartridge and P case, the inventors found that when a photosensitive material is kept in a miniaturized P case, bad influences are exerted on the photographic properties, particularly shelf-life, of the photosensitive material, while such bad influences are not observed when the material is kept in a conventional P case.

SUMMARY OF THE INVENTION

A primary object of the present invention is, therefore, to provide a miniaturized package of a photosensitive material comprising a photosensitive material contained in a closed container miniaturized in order to reduce the size and weight of a camera.

Another object of the present invention is to provide a miniaturized package of a photosensitive material, the photographic properties of the photosensitive material contained therein being not easily deteriorated and particularly having little susceptibility to fogging.

These and other objects of the present invention will be clear from the following description and Examples.

The present invention relates to a package of a photosensitive material comprising a silver halide photosensitive material consisting of a transparent synthetic resin support having at least one photosensitive silver halide emulsion layer formed thereon and a sealed container containing the photosensitive material, characterized in that the support has a water content of 0.3 to 1.5% by weight and the content volume of the sealed container is $0.08 \times cm^3$ or less when the area of one surface of the photosensitive material is $\times cm^2$.

Figure 1:
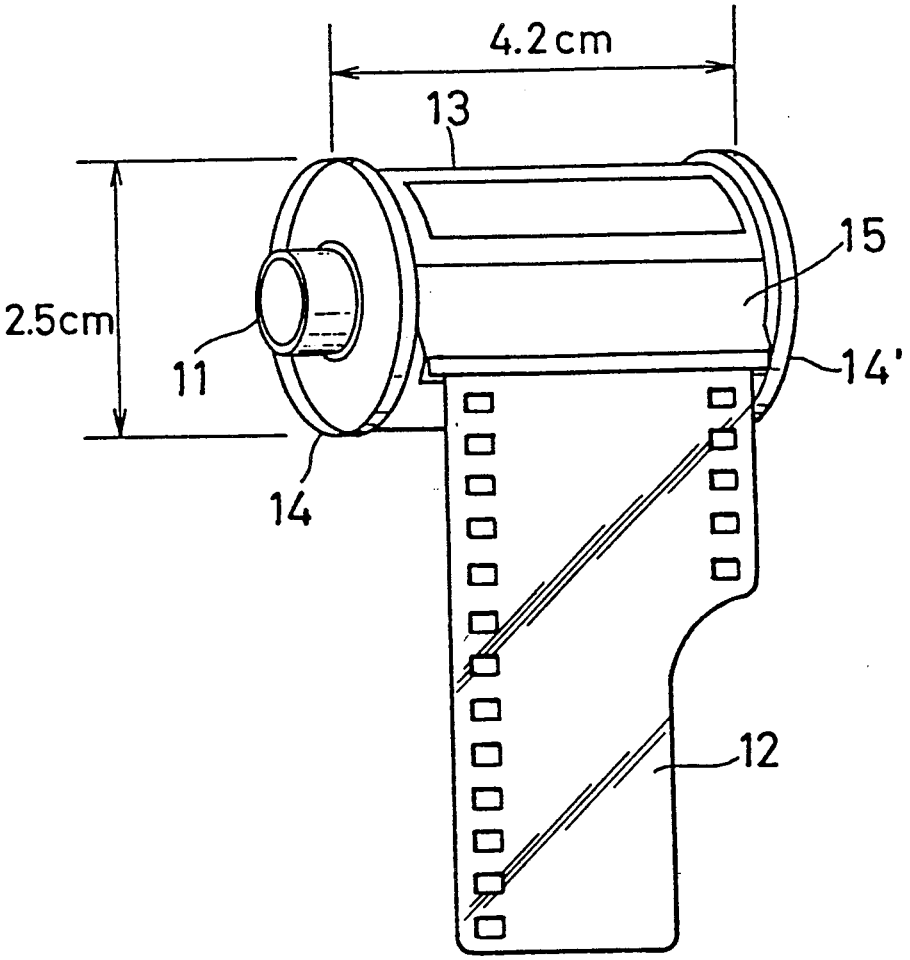
FIG. 1 is a perspective view showing a conventional cartridge and a part of a film strip contained therein.

11 spool
12 photographic filmstrip
13 cartridge body
14, 14' cap
15 light-shielding part
16 engagement hole for tooth
17 tooth
18 driving boss portion
19 circular supporting aperture
20 engagement holes for spool

DESCRIPTION OF THE PREFERRED EMBODIMENTS

The photosensitive material contained in the package of the present invention comprises a transparent synthetic resin support having a water content of 0.3 to 1.5% by weight. The material for the support is not particularly limited. The support can be, for example, a cellulose triacetate film, polyester film or the like. Polyester film is particularly preferred.

The water content of the film used as the support is determined by leaving the film to stand at a temperature of 23° C. and relative humidity of 30% for 3 h, immersing it in distilled water at 23° C. for 15 min and the water content thereof is determined with a micro moisture meter (for example, a CA-02 micro moisture meter manufactured by Mitsubishi Chemical Industries, Ltd.) at a drying temperature of 150° C.

The upper limit of the water content of the support film used in the present invention thus determined is 1.5% by weight, preferably 1.0% by weight. When the water content is less than 0.3% by weight, the curl of the film due to the rolling is disadvantageously strong even after the development.

The polyesters used for forming the support in the present invention mainly comprise an aromatic dibasic acid and a glycol. Typical examples of the dibasic acids include terephthalic acid and isophthalic acid. The glycols include, for example, ethylene glycol, propylene glycol, butanediol, neopentyl glycol, 1,4-cyclohexanediol and diethylene glycol. Among the polyesters composed of these components, polyethylene terephthalate (PET) is the most easily available on the market. The present invention will be described with reference to PET.

Copolymerized polyethylene terephthalate film preferably used in the present invention is prepared by using an aromatic dicarboxylic acid component having a metal sulfonate as the copolymerizable component.

The aromatic dicarboxylic acids having the metal sulfonate include 5-sodium sulfoisophthalic acid, 2-sodium sulfoterephthalic acid, 4-sodium sulfophthalic acid, 4-sodium sulfo-2,6-naphthalenedicarboxylic acid and corresponding compounds containing another metal such as potassium or lithium in place of sodium. The amount of the aromatic dicarboxylic acid having the metal sulfonate component is preferably 2 to 15 molar %, particularly 4 to 10 molar %, based on the main terephthalic acid component.

To obtain the transparent film, particularly to control the surface whitening and to obtain a high folding endurance of the copolymerized polyethylene terephthalate film, it is preferred that the copolymerized polyethylene terephthalate film used in the present invention be further copolymerized with an aliphatic dicarboxylic acid having 4 to 20 carbon atoms or a polyalkylene glycol having a high molecular weight.

The aliphatic dicarboxylic acids having 4 to 20 carbon atoms include, for example, succinic acid, adipic acid and sebacic acid. Among these, adipic acid is preferred. The amount of the aliphatic dicarboxylic acid having 4 to 20 carbon atoms to be copolymerized is preferably 3 to 25 molar %, particularly 5 to 20 molar %, based on the terephthalic acid component.

The polyalkylene glycol usable herein has an average molecular weight of about 600 to 20,000. Particularly preferred is polyethylene glycol. It is well known that the permeability to water vapor can be improved by adding a polyethylene glycol having a molecular weight of 600 to 20,000 in the step of forming the polyester. The polyalkylene glycol can be used either singly or in combination with the above-described aliphatic dicarboxylic acid having 4 to 20 carbon atoms. The amount of the polyalkylene glycol must be determined so that it does not impair the transparency or mechanical properties of the polyester film. When it is used as the component to be copolymerized, the amount thereof is preferably 10 wt % or less.

The water content of the polyester film can be adjusted by selecting the kind of the aromatic dicarboxylic acid having the metal sulfonate to be copolymerized therewith and the copolymerization ratio thereof. Generally the higher the relative amount of the aromatic dicarboxylic acid copolymerized, the higher the water content. Although the kind of the aliphatic dicarboxylic acid and drawing conditions exert an influence on the water content, it is only slight.

The haze of the polyester film determined according to ASTM-D 1003-52 is desirably 3% or below.

The thickness of the support used in the present invention, particularly the polyester film, is preferably 100 μm or less, particularly 85 μm or less, for the miniaturization of the cartridge. Further, to improve the pressure fogging or pressure sensitization caused when the sensitive material is folded, the thickness if particularly preferably 30 μm to 85 μm.

The polyethylene terephthalate film used in the present invention may contain various additives. One of the problems posed when the polyester film is used as the support for the photosensitive material is edge fog caused due to the high refractive index of the support. Typical examples of the photographic supports are polyester polymers such as triacetyl cellulose (TAC) and polyethylene terephthalate (PET). A remarkable difference in the optical properties between TAC and PET resides in the refractive index. In particular, the refractive index of PET is about 1.6, while that of TAC is as low as 1.5. The refractive index of gelatin frequently used for forming a prime layer or photographic emulsion layer is 1.50 to 1.55. The ratio of the refractive index of gelatin to that of PET is less than 1 (1.5/1.6). This fact indicates that when a light comes through the film edge, it reflects at the interface between the base and the emulsion layer. Therefore, the polyester film causes the so-called ride piping (edge fog) phenomenon.

Methods for avoiding this phenomenon are known. They include, for example, a method wherein inert inorganic grains are incorporated into the film and a method wherein a dye is added thereto. A preferred method for avoiding this phenomenon comprises adding a dye which does not seriously increase the film haze.

The dyes used for dyeing the film are not particularly limited. The color tone is preferably gray from the viewpoint of the general properties of the photosensitive material. The dyes are preferably those having excellent thermal resistance within the temperature range employed in the polyester film formation and an excellent compatibility with the polyester.

This object can be attained by using a commercially available dye for polyesters such as Diaresin (a product of Mitsubishi Chemical Industries, Ltd.) or Kayaset (a product of Nippon Kayaku Co., Ltd.).

The color density of the dye must be at least 0.01, preferably at least 0.03 as determined in the visible ray region with a color densitometer (a product of Macbeth Co.).

The polyester film used in the present invention can be lubricated depending on the use thereof. The lubrication means is not particularly limited. Usually, the lubrication is conducted by incorporation of an inert inorganic compound or by coating with a surfactant.

The inert inorganic particles include, for example, $SiO_2$, $TiO_2$, $BaSO_4$, $CaCO_3$, talc and kaolin. The lubrication can be conducted by an external particle system in which the inert particles are added to the polyester-forming reaction system, or by internal particle system in which the catalyst, etc. added during the polyester-forming reaction are deposited.

Although the lubrication means is not particularly limited, $SiO_2$ having a refractive index close to that of the polyester film is preferably used in the external particle system, since transparency is an important requirement of the support. It is also desirable to employ the internal particle system which enables the diameter of the deposited particles to be relatively small.

When the lubrication is conducted by the incorporation method, it is also preferred to form another layer effective for improving the transparency of the film. This is conducted by, for example, the coextrusion method wherein two or more extruders, a feed block or multi-manifold die is used.

The deposition of a low polymer in the heat treatment in the formation of the prime layer may pose a problem depending on the copolymerization ratio. In such a case, an ordinary polyester layer is formed on at least one surface of the support. The co-extrusion method can be employed as an effective method in this case.

The starting polymer for the copolymerized polyethylene terephthalate film used in the present invention can be produced by a well known method of producing polyesters. For example, the acid is directly esterified with the glycol component. In another method wherein a dialkyl ester is used as the acid component, it is transesterified with the glycol component and the product is heated under reduced pressure to remove excess glycol component thereby to obtain the copolymerized polyethylene terephthalate. If necessary, a transesterification reaction catalyst or polymerization reaction catalyst can be used or a heat stabilizer can be used.

The copolymerized polyethylene terephthalate thus obtained is usually granulated, dried and melt-extruded to form a non-stretched sheet, which is then biaxially oriented and heat-treated to obtain the intended film.

In the biaxial orientation step, successive orientation in the lengthwise and widthwise directions or simultaneous biaxial orientation can be conducted. Although the orientation ratio is not particularly limited, it is usually 2.0 to 5.0. After the biaxial orientation, the film can be further oriented in either direction.

Prior to the melt extrusion, the film is dried preferably by the vacuum drying method or dehumidification method.

The orientation temperature is desirably 70° to 100° C. (lengthwise orientation) and 80° to 160° C. (widthwise orientation).

The thermal fixation temperature is 150° to 210° C., particularly 160° to 200° C.

The above-described copolymer composition maintains the excellent transparency and mechanical strength which are intrinsic properties of PET, and has a film haze of 3% or less, breaking strength of 8 to 25 $kg/mm^2$, initial modulus of 200 to 500 $kg/mm^2$ and a tear strength of at least 30 g in case of film thickness being 50 μm. When the strength of the composition is less than those mentioned above, the intrinsic excellent mechanical properties of PET are impaired and the product is no more superior to TAC.

The transparency, breaking strength, initial modulus and tear strength were determined as follows:

Transparency

The haze of the film was determined according to ASTM-D 1003-52.

Breaking strength and initial modulus

Pieces having a width of 10 mm and a length of 100 mm were prepared according to JIS-Z 1702-1976. The rate of pulling was 300 mm/min in the determination of the breaking strength and 20 mm/min in the determination of the initial modulus.

Tear Strength

Samples having a size of 51×64 mm with a 13 mm notch were tested with a light load-type tear strength tester (a product of Toyo Seiki Co., Ltd.). The indicated value shown when the remaining length (51 mm) of the sample was torn was read.

The copolymerized polyethylene terephthalate film used in the present invention has an excellent adhesion to coating layers such as emulsion layers.

If necessary, the polyester film used in the present invention can be subjected to various surface treatments such as corona discharge treatment, treatment with a chemical solution and treatment with a flame in order to improve the adhesion and wettability with the coating liquid. Among the surface treatments, the most preferred is the corona discharge treatment which enables only slight deposition of a low polymer on the film surface.

It is preferred to form a prime layer on the polyester support used in the present invention in order to increase the adhesion to a photographic layer such as a photosensitive layer to be formed thereon.

The prime layer is prepared by using a polymer latex comprising a styrene/butadiene copolymer or vinylidene chloride copolymer or a hydrophilic binder such as gelatin.

The prime layer prepared from the hydrophilic binder is preferred in the present invention.

The hydrophilic binders include, for example, water-soluble polymers, cellulose esters, latex polymers and water-soluble polyesters. The water-soluble polymers include, for example, gelatin, gelatin derivatives, casein, agar, sodium alginate, starch, polyvinyl alcohol, polyacrylic copolymers and maleic anhydride copolymers. The cellulose esters include, for example, carboxymethyl cellulose and hydroxyethyl cellulose. The latex polymers include, for example, vinyl chloride-containing copolymers, vinylidene chloride-containing copolymers, acrylic ester-containing copolymers, vinyl acetate-containing copolymers and butadiene-containing copolymers. Among these, gelatin is the most preferred.

Compounds capable of swelling the support used in the present invention include, for example, resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate. Among these, resorcin and p-chlorophenol are preferred.

The prime layer may contain a gelatin-hardener.

The gelatin-hardeners include, for example, chromium salts (such as chromium alum), aldehydes (such as formaldehyde and glutaraldehyde), isocyanates, active halogen compounds (such as 2,4-dichloro-6-hydroxy-S-triazine) and epichlorohydrin.

The prime layer may contain fine particles of inorganic substances such as $SiO_2$ and $TiO_2$ or those of polymethyl methacrylate copolymer (1 to 10 μm) as a matting agent.

The prime layer can be formed by a well known coating method such as dip coating method, air-knife coating method, curtain coating method, wire bar coating method, gravure coating method or extrusion coating method.

The photosensitive material contained in the package of the present invention can have a non-photosensitive layer such as an antihalation layer, intermediate layer, backing layer and surface-protecting layer in addition to the photosensitive layer.

The binder in the backing layer may be a hydrophobic polymer or a hydrophilic polymer similar to that used in the prime layer.

The backing layer of the photosensitive material of the present invention can contain an antistatic agent, lubricating agent, matting agent, surfactant, dye, etc. The antistatic agents which can be contained in the backing layer of the present invention are not particularly limited. They include, for example, anionic polymeric electrolytes such as those containing a carboxylic acid, carboxylate or sulfonate as described in, for example, J.P. KOKAI No. 48-22017, J.P. KOKOKU No. 46-24159 and J.P. KOKAI Nos. 51-30725, 51-129216 and 55-95942; cationic polymers such as those described in J.P. KOKAI Nos. 49-121523 and 48-91165 and J.P. KOKOKU No. 49-24582; and ionic surfactants such as anionic and cationic surfactants including compounds described in, for example, J.P. KOKAI Nos. 49-85826 and 49-33630, U.S. Pat. Nos. 2,992,108 and 3,206,312, J.P. KOKAI No. 48-87826, J.P. KOKOKU Nos. 49-11567 and 49-11568 and J.P. KOKAI No. 55-70837.

The most preferred antistatic agent in the backing layer is at least one crystalline metal oxide selected from the group consisting of ZnO, $TiO_3$, $SnO_2$, $Al_2O_3$, $InO_3$, $SiO_3$, MgO, BaO and $MoO_3$ or compound oxides of these metals in the form of fine particles.

The fine particles of the conductive crystalline oxide or compound oxide thereof have a volume resistivity of $10^7$ Ω cm or below, preferably $10^5$ Ω cm or below. Their particle size is 0.01 to 0.7 μm, particularly 0.02 to 0.5 μm.

Processes for producing the conductive crystalline metal oxides or compound oxides are described in detail in J.P. KOKAI Nos. 56-143430 and 60-258541. Easy processes are, for example, (1) a process wherein fine particles of a metal oxide are prepared by calcination and they are heat-treated in the presence of a foreign atom capable of improving the conductivity, (2) a process wherein a foreign atom capable of improving the conductivity is used in the step of producing fine particles of the metal oxide and (3) a process wherein oxygen concentration of the atmosphere is reduced to realize oxygen deficiency in the step of producing fine metal particles by the calcination. The foreign atoms for ZnO include Al, In, etc.; those for $TiO_2$ include Nb, Ta, etc.; and those for $SnO_2$ include Sb, Nb and halogen elements. The amount of the foreign atom used is preferably in the range of 0.01 to 30 molar %, particularly 0.1 to 10 molar %.

PREPARATION EXAMPLE (1) Preparation of polyethylene Terephthalate film:

0.1 part by weight of calcium acetate and 0.03 part by weight of antimony trioxide were added to a mixture of 100 parts by weight of dimethyl terephthalate, 70 parts by weight of ethylene glycol, 10 parts by weight of dimethyl 5-sodium sulfoisophthalate (SSIT) and 10 parts by weight of dimethyl adipate. The transesterification reaction was conducted in an ordinary manner. 0.05 part by weight of trimethyl phosphate was added to the resulting product. The temperature was slowly elevated and the pressure was slowly reduced. The polymerization was finally conducted at 280° C. under 1 mmHg or below to obtain a copolymerized polyethylene terephthalate.

The copolymerized polyethylene terephthalate was dried in an ordinary manner and then melt-extruded at 280° C. to obtain a non-oriented sheet. It was oriented longitudinally at 90° C. 3.5-fold and then widthwise at 5° C. 3.7-fold. Thereafter it was thermally fixed at 200° C. for 5 sec to obtain a biaxially oriented film having a thickness of 100 μ. The film had a water content of 0.7% by weight. The film had a haze of 1.2%, breaking strength of 12 kg/mm, initial modulus of 340 kg/mm and excellent transparency and mechanical properties.

The transparency, breaking strength and initial modulus were determined as follows:

Transparency:

The haze of the film was determined according to ASTM-D 1003-52.

Breaking strength and initial modulus:

Pieces having a width of 10 mm and a length of 100 mm were prepared according to JIS-Z 1702-1976. The rate of pulling was 300 mm/min in the determination of the breaking strength and 20 mm/min in the determination of the initial modulus.

By varying the amount of SSIT used in the above Example within the range of about 5 to 20 parts by weight, a copolymerized polyester having a water content of 0.3 to 1.5% by weight can be obtained.

The relationship between the amounts of ethylene glycol, SSIT and dimethyl adipate and water content in the preparation of the above-described polyethylene terephthalate is shown below.

| PET film No. | 1 | 2 | 3 | 4 | 5 |
|---|---|---|---|---|---|
| Ethylene glycol (% by weight) | 70 | 70 | 70 | 70 | 70 |
| SSIT (% by weight) | — | 10 | 13 | 15 | 19 |
| Dimethyl adipate (% by weight) | — | 10 | 10 | 10 | 10 |
| Water content (%) | 0.25 | 0.7 | 1.0 | 1.3 | 1.8 |

(2) Formation of prime layer:

The both surfaces of PET film (PET-2) of the present invention and a commercially available PET film (PET-1) were subjected to the corona discharge treatment and then a prime layer having the following composition was formed thereon. The degree of the corona discharge in the treatment was 0.02 KVA·min/$m^2$.

| | |
|---|---|
| Gelatin | 3 g |
| Distilled water | 250 cc |
| Sodium-α-sulfodi-2-ethylhexyl succinate | 0.05 g |
| Formaldehyde | 0.02 g |

(3) Formation of backing layer:

A backing layer having a composition which will be shown below was formed on one surface of the PET film after forming the prime layer.

Preparation of Tin Oxide/Antimony Oxide Complex Dispersion 230 parts by weight of stannic chloride and 23 parts by weight of antimony trichloride were dissolved in 3000 parts by weight of ethanol to obtain a homogeneous solution. 1N aqueous sodium hydroxide solution was added dropwise to the solution until the pH became 3 to form a co-precipitate of colloidal stannic oxide and antimony oxide. The solution was left to stand at 50° C. for 24 h to obtain a reddish brown colloidal precipitate.

The reddish brown colloidal precipitate was separated by centrifugation. Excess ions were removed by washing with water by adding water to the precipitate and centrifugating the mixture. This operation was repeated three times to remove the excess ions.

200 parts by weight of the excess ion-free colloidal precipitate was dispersed again in 1500 parts by weight of water and the dispersion was sprayed into a calcination furnace heated to 600° C. to obtain a bluish fine powder of tin oxide/antimony oxide complex having an average particle diameter of 0.2 μm. The powder had a specific resistance of 25 Ω·cm.

A mixture of 40 parts by weight of the fine powder and 60 parts by weight of water was adjusted to pH 7.0, roughly dispersed with a stirrer and then dispersed with a horizontal sand mill (trade name: DYNO-MILL; a product of Willya Bachofen AG) until the residence time became 30 min.

Formation of Backing Layer

A composition having the following formulation [A] was applied to the film in a thickness of 0.3μ (on dry basis) and then dried at 130° C. for 30 sec. Then a coating solution having the following composition (B) was applied thereto to form a 0.1μ layer (on dry basis). It was dried at 130° C. for 2 min.

| [Formulation A] | |
|---|---|
| Dispersion of conductive fine particles | 10 parts by wt. |
| Gelatin | 1 part by wt. |

-continued

| | |
|---|---|
| Water | 27 parts by wt. |
| Methanol | 60 parts by wt. |
| Resorcin | 2 parts by wt. |
| Polyoxyethylene nonylphenyl ether | 0.01 part by wt. |
| [Coating solution for forming coating layer (B)] | |
| Cellulose triacetate | 1 part by wt. |
| Acetone | 70 parts by wt. |
| Methanol | 15 parts by wt. |
| Dichloromethylene | 10 parts by wt. |
| p-Chlorophenol | 4 parts by wt. |

The sealed container used in the present invention has a content volume of $0.08\times cm^3$ or less when the area of one surface of the photosensitive material is $\times cm^2$. The content volume of the sealed container is preferably $0.05\times cm^3$ to $0.01\times cm^3$, particularly $0.035\times cm^3$ to $0.01\times cm^3$.

Any type of sealed container will suffice so far as the photosensitive material contained therein can be shut off from the outside. The term 'shut off' here indicates that the circulation of air through the container is substantially intercepted. Therefore, any container satisfying this condition is usable irrespective of the material or shape thereof. For example, it can be a container with a lid made of a resin having a low permeability to water vapor such as polyethylene, polypropylene or polyvinyl chloride. It may be in the form of a cylinder like an ordinary P case (see FIG. 2) or rectangular parallelpiped (see FIGS. 4 and 5). Although the ordinary patrone per se does not have the sealing properties, the patrone per se can be made sealable for use as the sealing container without need for a Pcase. When an end of the photosensitive material (film) does not project through a slit of the patrone but is kept in the patrone, the patrone per se does not have to be sealed or the patrone can be sealed in a moisture-proof film (such as a polyethylene film, polypropylene film or polyvinyl chloride film) under reduced pressure.

The package of the present invention can contain various photosensitive material including black-and-white and color photosensitive materials. Typical examples of the color photosensitive materials include, ordinary or cinema color negative films, color reversal films for slides and television, and color positive films.

The present invention is preferably applicable to the ordinary color negative films. The present invention will be, therefore, illustrated with reference to ordinary color negative films.

At least one layer among a blue-sensitive layer, a green-sensitive layer and a red-sensitive layer comprising a silver halide emulsion is formed on the support to form the photosensitive material of the present invention. The number or the order of the arrangement of the silver halide emulsion layer(s) and the photosensitive layer(s) are not particularly limited. A typical example of the silver halide photosensitive material comprises at least one photosensitive layer (comprising two or more silver halide emulsion layer having substantially the same color sensitivity but different degree of sensitivity) formed on the support. The photosensitive layer is a unit photosensitive layer sensitive to any of blue, green and red light. In the multi-layered silver halide color photosensitive materials, the arrangement of the unit photosensitive layers is: a red-sensitive layer, a green-sensitive layer and a blue-sensitive layer in this order from the support. However, the order may be reversed or a sensitive layer may be interposed between two layers sensitive to another color depending on the purpose.

A photosensitive layer such as an intermediate layer can be provided between the silver halide photosensitive layers or as the top layer or the bottom layer.

The intermediate layer may contain a coupler or DIR compound as described in J. P. KOKAI Nos. 61-43748, 59-113438, 59-113440, 61-20037 and 61-20038, or an ordinary color-mixing inhibitor.

The two or more silver halide emulsion layers constituting the unit photosensitive layer have preferably a structure consisting of two layers, i.e. a high sensitivity emulsion layer and a low sensitivity emulsion layer, as described in West German Patent No. 1,121,470 or British Patent No. 923,045. Usually the arrangement of the layers is such that the sensitivity thereof decreases gradually toward the support. A photoinsensitive layer may be provided between the silver halide emulsion layers. An emulsion layer having a low sensitivity may be formed away from the support and an emulsion layer having a high sensitivity may be formed close to the support as described in J. P. KOKAI Nos. 57-112751, 62-200350, 62-206541 and 62-206543.

An example of the arrangement is a structure of a blue-sensitive layer having a low sensitivity (BL)/blue-sensitive layer having a high sensitivity (BH)/green-sensitive layer having a high sensitivity (GH)/green-sensitive layer having a low sensitivity (GL)/red-sensitive layer having a high sensitivity (RH)/red-sensitive layer having a low sensitivity (RL); BH/BL/GL/GH/RH/RL or BH/BL/GH/GL/RL/RH toward the support.

As described in J. P. KOKOKU No. 55-34932, the arrangement may be a blue-sensitive layer /GH/RH/GL/RL toward the support. Another arrangement is a blue-sensitive layer/GL/RL/GH/RH toward the support as described in J. P. KOKAI Nos. 56-25738 and 62-63936.

Another arrangement is that of three layers having sensitivities gradually lowered toward the support, i.e. a top layer (a silver halide emulsion layer having the highest sensitivity), middle layer (a silver halide emulsion layer having a lower sensitivity) and bottom layer (a silver halide emulsion layer having a sensitivity lower than that of the middle layer) as described in J. P. KOKOKU No. 49-15495. Even in such an arrangement, a sensitive layer may comprise further an emulsion layer having a medium sensitivity/emulsion layer having a high sensitivity/emulsion layer having a low sensitivity in the order toward the support as described in J. P. KOKAI No. 59-202464.

Thus the layer construction and the arrangement can be selected suitably for the use of the photosensitive material.

Preferred silver halides other than tabular silver halides contained in the photographic emulsion layers of the photosensitive material used in the present invention include silver bromoiodide, silver chloroiodide and silver chlorobromoiodide, which contain about 30 molar % or less of silver iodide. Particularly preferred is silver bromoiodide or silver chlorobromoiodide containing about 2 to 25 molar % of silver iodide.

The silver halide grains may be in a regular crystal form such as a cubic, octahedral or tetradecahedral form; an irregular crystal form such as spherical or plate form; or a complex crystal form thereof. They include also those having a crystal fault such as a twin plate.

The silver halide grain diameter may range from about 0.2 μm or less to as large as that the projection area diameter thereof is about 10 μm. The emulsion may be either a polydisperse emulsion or monodisperse emulsion.

The silver halide photographic emulsion usable in the present invention can be prepared by processes described in, for example, 'Research Disclosure (RD)' No. 17643 (December, 1978), pages 22 to 23, '1. Emulsion Preparation and types'; RD No. 18716 (November, 1979), p. 648; P. Glafkides, 'Chemic et Phisique Photographique', Paul Montel, 1967; G. F. Duffin, 'Photographic Emulsion Chemistry' (Focal Press, 1966); and V. L. Zelikman et al., 'Making and Coating Photographic Emulsion', (Focal Press, 1964).

Monodisperse emulsions described in U.S. Pat. Nos. 3,574,628 and 3,655,394 and British Patent No. 1,413,748 are also preferred.

Tabular grains having an aspect ratio of 5 or higher are also usable. The tabular grains can be easily prepared by processes described in, for example, Gutoff, 'Photographic Science and Engineering', Vol. 14, pages 248 to 257 (1970); U.S. Pat. Nos. 4,434,226, 4,414,310, 4,433,048 and 4,439,520 and British Patent No. 2,112,157.

The crystal structure of the grains in the above emulsion may be uniform; the grains may comprise an inside portion and an outside portion which are composed of silver halides different from each other; or the structure may be a laminated one. Different silver halide grains can be bonded together by an epitaxial bond or they can be bonded with a compound other than silver halides such as silver rhodanate or lead oxide.

A mixture of grains having various crystal forms can also be used.

The silver halide emulsion to be used in the present invention is usually physically and chemically ripened and spectrally sensitized. The additives to be used in these steps are shown in Research Disclosure Nos. 17643 and 18716. The portions in which the additives are mentioned in these two Research Disclosure's are summarized in the following table.

Known photographic additives are also mentioned in the two Research Disclosures and the corresponding portions are also shown in the following table.

| Additive | RD 17643 | RD 18716 |
|---|---|---|
| 1 Chemical sensitizer | p. 23 | right column, p. 648 |
| 2 Sensitivity improver | | right column, p. 648 |
| 3 Spectral sensitizer Supersensitizer | pp. 23 to 24 | right column, p. 648 to right column, p. 649 |
| 4 Brightening agent | p. 24 | |
| 5 Antifoggant and stabilizer | pp. 24 to 25 | right column, p. 649 |
| 6 Light absorber, filter dye and U.V. absorber | pp. 25 to 26 | right column, p. 649 to left column, p. 650 |
| 7 Antistaining agent | right column, p. 25 | left and right columns, p. 650 |
| 8 Dye image stabilizer | p. 25 | |
| 9 Hardener | p. 26 | left column, p. 651 |
| 10 Binder | p. 26 | " |
| 11 Plasticizer and lubricant | p. 27 | right column, p. 650 |
| 12 Coating aid and surfactant | pp. 26 and 27 | " |
| 13 Antistatic agent | p. 27 | " |

To prevent the deterioration of the photographic properties by gaseous formaldehyde, it is preferred to add to the photosensitive material a compound capable of reacting with formaldehyde to fix it as described in U.S. Pat. Nos. 4,411,987 and 4,435,503.

Various color couplers can be used in the present invention. Examples are given in patents described in the above-described Research Disclosure (RD) No. 17643, VII-C to G.

Preferred yellow couplers are those described in, for example, U.S. Pat. Nos. 3,933,501, 4,022,620, 4,326,024, 4,401,752 and 4,248,961, J. P. KOKOKU No. 58-10739, British Patent Nos. 1,425,020 and 1,476,760, U.S. Pat. Nos. 3,973,968, 4,314,023 and 4,511,649, and European Patent No. 249,473A.

The magenta couplers usable in the present invention are preferably 5-pyrazolone couplers and pyrazoloazole couplers. Particularly preferred are those described in U.S. Pat. Nos. 4,310,619 and 4,351,897, European Patent No. 73,636, U.S. Pat. Nos. 3,061,432 and 3,725,064, Research Disclosure No. 24220 (June, 1984), J. P. KOKAI No. 60-33552, Research Disclosure No. 24230 (June, 1984), J. P. KOKAI Nos. 60-43659, 61-72238, 60-35730, 55-118034 and 60-185951, U.S. Pat. Nos. 4,500,630, 4,540,654 and 4,556,630, and WO (PCT) 88/04795.

The cyan couplers usable in the present invention are phenolic and naphtholic couplers. Preferred cyan couplers are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329,729, European Patent Nos. 121,365A and 249,453A, U.S. Pat. Nos. 3,446,622, 4,333,999, 4,753,871, 4,451,559, 4,427,767, 4,690,889, 4,254,212 and 4,296,199 and J. P. KOKAI No. 61-42658.

Colored couplers used for compensation for unnecessary absorption of the colored dye are preferably those described in Research Disclosure No. 17643, VII-G, U.S. Pat. No. 4,163,670, J. P. KOKOKU No. 57-39413, U.S. Pat. Nos. 4,004,929 and 4,138,258 and British Patent No. 1,146,368.

The couplers capable of forming a color dye having a suitable diffusivity are preferably those described in U.S. Pat. No. 4,366,237, British Patent No. 2,125,570, European Patent No. 96,570 and West German Patent No. 3,234,533.

Typical examples of the polymerized color-forming couplers are described in, for example, U.S. Pat. Nos. 3,451,820, 4,080,211, 4,367,282, 4,409,320 and 4,576,910 and British Patent No. 2,102,173.

Further, couplers which release a photographically useful residual group during a coupling reaction are also preferably usable in the present invention. DIR couplers which release a development inhibitor are preferably those described in the patents shown in the above described RD 17643, VII-F as well as J. P. KOKAI No. 57-151944, 57-154234, 60-184248 and 63-37346 and U.S. Pat. No. 4,248,962.

The couplers which release a nucleating agent or a development accelerator in the image-form are preferably those described in British Patent Nos. 2,097,140 and 2,131,188 and J. P. KOKAI Nos. 59-157638 and 59-170840.

Other couplers usable for the photosensitive material of the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in J. P. KOKAI Nos. 60-185950 and 62-24252, couplers which release a dye that restores the color after coupling-off described in European Patent No. 173,302A, bleach-accelerator-releasing couplers described in R.D. Nos. 11449 and 24241 and J. P. KOKAI No. 61-201247, ligand-releasing couplers described in U.S. Pat. No. 4,553,477, and leuco dye-releasing couplers described in J. P. KOKAI No. 63-75747.

The coupler used can be incorporated into the photosensitive material by various known dispersion methods.

High-boiling solvents used for an oil-in-water dispersion method are described in, for example, U.S. Pat. No. 2,322,027.

The high-boiling organic solvents having a boiling point under atmospheric pressure of at least 175° C. and usable in the oil-in-water dispersion method include, for example, phthalates [such as dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl)phthalate], phosphates and phosphonates [such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphate], benzoates [such as 2-ethylhexyl benzoate, dodecyl benzoate and 2-ethylhexyl-p-hydroxybenzoate], amides [such as N,N-diethyldodecaneamide, N,N-diethyllaurylamide and N-tetradecylpyrrolidone], alcohols and phenols [such as isostearyl alcohol and 2,4-di-tert-amylphenol], aliphatic carboxylates [such as bis(2-ethylhexyl)sebacate, dioctyl azelate, glycerol tributylate, isostearyl lactate and trioctyl citrate], aniline derivatives [such as N,N-dibutyl-2-butoxy-5-tert-octylaniline] and hydrocarbons [such as paraffin, dodecylbenzene and diisopropylnaphthalene]. Co-solvents usable in the present invention include, for example, organic solvents having a boiling point of at least about 30° C., preferably 50 to about 160° C. Typical examples include ethyl acetate, butyl acetate, ethyl propionate, methyl ethyl ketone, cyclohexanone, 2-ethoxyethyl acetate and dimethylformamide.

The steps and effects of the latex dispersion method and examples of the latices usable for the impregnation are described in, for example, U.S. Pat. No. 4,199,363 and West German Patent Application (OLS) Nos. 2,541,274 and 2,541,230.

The photosensitive material of the present invention has a total thickness of the hydrophilic colloidal layers on the emulsion layerside of 28 μm or less and a film-swelling rate $T_{\frac{1}{2}}$ of preferably 30 sec or less. The thickness is determined at 25° C. and at a relative humidity of 55% (2 days). The film-swelling rate $T_{\frac{1}{2}}$ can be determined by a method known in this technical field. For example, it can be determined with a swellometer described on pages 124 to 129 of A. Green et al. 'Photogr. Sci. Eng.', Vol. 19, No. 2. $T_{\frac{1}{2}}$ is defined to be the time required for attaining the thickness of $T_{\frac{1}{2}}$ which is the saturated film thickness (corresponding to 90% of the maximum film thickness swollen with the color developer at 30° C. for 3 min 15 sec.).

The film-swelling rate $T_{\frac{1}{2}}$ can be controlled by adding a hardener to gelatin used as the binder or by varying the time conditions after the coating. The swelling rate is preferably 150 to 400%. The swelling rate is calculated according to the following formula:

$$[(\text{maximum swollen film thickness})-(\text{film thickness})]/(\text{film thickness})$$

wherein the maximum swollen film thickness is determined under the above-described conditions.

Although the sensitivity of the photosensitive material used in the present invention is not particularly limited, the photosensitive materials having a high sensitivity are particularly preferred, since they are substantially free from a fog during the storage. Therefore, the photosensitive materials having a specific photosensitivity of at least 100, preferably at least 400, are particularly preferred for the package of the present invention.

The term 'specific photosensitivity' here is a photosensitivity determined by the method of JIS K 7614-1981 for the determination of ISO sensitivity. In this method, the photosensitive material is exposed for the sensitometry, and after one hour, it is developed according to Negative Processing Formulation CN-16 of Fuji Photo Film Co., Ltd. to determine the photosensitivity, without leaving it for five days. The sample standing time prescribed in the JIS test method is reduced herein in order to obtain the results rapidly. It is described in JIS that the development process may be varied from company to company.

The details of the test method for determining the specific photosensitivity are described from the left upper column on page (4) [page 440] to the right upper column on page (6) [page 442] of J.P. KOKAI No. 63-226650 (Japanese Patent Application No. 62-159115 based on the priority of Japanese Patent Application No. 61-201756).

The color photosensitive material used in the present invention can be developed by an ordinary method described in, for example, the above-described R.D. No. 17643, pages 28 to 29 and R.D. No. 18716, page 615, left to the right columns. However, the development process is not limited thereto.

The silver halide color photosensitive material used in the present invention may contain a color developing agent for the purpose of simplifying and accelerating the color developing process. For this purpose, precursors of the color developing agents are preferred. They include, for example, indoaniline compounds described in U.S. Pat. No. 3,342,597, Schiff bases described in U.S. Pat. No. 3,342,599, Research Disclosure Nos. 14,850 and 15,159, aldol compounds described in Research Disclosure No. 13,924, metal salt complexes described in U.S. Pat. No. 3,719,492 and urethane compounds described in J.P. KOKAI No. 53-135628.

If necessary, the silver halide color photosensitive material used in the present invention may contain a 1-phenyl-3-pyrazolidone in order to accelerate the color development. Typical examples of these compounds are described in J.P. KOKAI No. 56-64339, 57-144547 and 58-115438.

The photosensitive materials of the present invention also include heat-developable photosensitive materials described in, for example, U.S. Pat. No. 4,500,626, J.P. KOKAI Nos. 60-133449, 59-218443 and 61-238056 and European Patent No. 210,660A2.

EXAMPLE 1

Sample A which was a multi-layered color photosensitive material composed of layers of the following compositions formed on a primed cellulose triacetate film support was prepared.

Compositions of the Photosensitive Layers

The numerals for the components each show the amount of the coating (g/m$^2$). The amounts of the silver halides are given in terms of silver applied. The amount of the sensitizing dye is shown in terms of the molar number thereof per mol of the silver halide contained in the same layer.

| (Sample A) | | |
|---|---|---|
| The first layer (antihalation layer): | | |
| black colloidal silver | silver | 0.18 |
| gelatin | | 0.40 |
| The second layer (intermediate layer): | | |
| 2,5-di-t-pentadecylhydroquinone | | 0.18 |
| EX-1 | | 0.07 |
| EX-3 | | 0.02 |
| EX-12 | | 0.002 |
| U-1 | | 0.06 |
| U-2 | | 0.08 |
| U-3 | | 0.10 |
| HBS-1 | | 0.10 |
| HBS-2 | | 0.02 |
| gelatin | | 1.04 |
| The third layer (the first red-sensitive emulsion layer) | | |
| Emulsion A | silver | 0.25 |
| Emulsion B | silver | 0.25 |
| Sensitizing Dye I | | $6.9 \times 10^{-5}$ |
| Sensitizing Dye II | | $1.8 \times 10^{-5}$ |
| Sensitizing Dye III | | $3.1 \times 10^{-4}$ |
| EX-2 | | 0.335 |
| EX-10 | | 0.020 |
| gelatin | | 0.87 |
| The fourth layer (the second red-sensitive emulsion layer) | | |
| Emulsion C | silver | 1.0 |
| Sensitizing Dye I | | $5.1 \times 10^{-5}$ |
| Sensitizing Dye II | | $1.4 \times 10^{-5}$ |
| Sensitizing Dye III | | $2.3 \times 10^{-4}$ |
| EX-2 | | 0.400 |
| EX-3 | | 0.050 |
| EX-10 | | 0.015 |
| gelatin | | 1.30 |
| The fifth layer (the third red-sensitive emulsion layer) | | |
| Emulsion D | silver | 1.60 |
| Sensitizing Dye I | | $5.4 \times 10^{-5}$ |
| Sensitizing Dye II | | $1.4 \times 10^{-5}$ |
| Sensitizing Dye III | | $2.4 \times 10^{-4}$ |
| EX-3 | | 0.010 |
| EX-4 | | 0.080 |
| EX-2 | | 0.097 |
| HBS-1 | | 0.22 |
| HBS-2 | | 0.10 |
| gelatin | | 1.63 |
| The sixth layer (intermediate layer) | | |
| EX-5 | | 0.040 |
| HBS-1 | | 0.020 |
| gelatin | | 0.80 |
| The seventh layer (the first green-sensitive emulsion layer) | | |
| Emulsion A | silver | 0.15 |
| Emulsion B | silver | 0.15 |
| Sensitizing Dye V | | $3.0 \times 10^{-5}$ |
| Sensitizing Dye VI | | $1.0 \times 10^{-4}$ |
| Sensitizing Dye VII | | $3.8 \times 10^{-4}$ |
| EX-6 | | 0.260 |
| EX-1 | | 0.021 |

-continued

| (Sample A) | | |
|---|---|---|
| EX-7 | | 0.030 |
| EX-8 | | 0.025 |
| HBS-1 | | 0.100 |
| HBS-3 | | 0.010 |
| gelatin | | 0.63 |
| The eighth layer (the second green-sensitive emulsion layer) | | |
| Emulsion C | silver | 0.45 |
| Sensitizing Dye V | | $2.1 \times 10^{-5}$ |
| Sensitizing Dye VI | | $7.0 \times 10^{-5}$ |
| Sensitizing Dye VII | | $2.6 \times 10^{-4}$ |
| EX-6 | | 0.094 |
| EX-8 | | 0.018 |
| EX-7 | | 0.026 |
| HBS-1 | | 0.160 |
| HBS-3 | | 0.008 |
| gelatin | | 0.50 |
| The ninth layer (the third green-sensitive emulsion layer) | | |
| Emulsion E | silver | 1.2 |
| Sensitizing Dye V | | $3.5 \times 10^{-5}$ |
| Sensitizing Dye VI | | $8.0 \times 10^{-5}$ |
| Sensitizing Dye VII | | $3.0 \times 10^{-4}$ |
| EX-13 | | 0.015 |
| EX-11 | | 0.100 |
| EX-1 | | 0.025 |
| HBS-1 | | 0.25 |
| HBS-2 | | 0.10 |
| gelatin | | 1.54 |
| The tenth layer (yellow filter layer) | | |
| yellow colloidal silver | silver | 0.05 |
| EX-5 | | 0.08 |
| HBS-1 | | 0.03 |
| gelatin | | 0.95 |
| The eleventh layer (the first blue-sensitive emulsion layer) | | |
| Emulsion A | silver | 0.08 |
| Emulsion B | silver | 0.07 |
| Emulsion F | silver | 0.07 |
| Sensitizing Dye VIII | | $3.5 \times 10^{-4}$ |
| EX-9 | | 0.721 |
| EX-8 | | 0.042 |
| HBS-1 | | 0.28 |
| gelatin | | 1.10 |
| The twelfth layer (the second blue-sensitive emulsion layer) | | |
| Emulsion G | silver | 0.45 |
| Sensitizing Dye VIII | | $2.1 \times 10^{-4}$ |
| EX-9 | | 0.154 |
| EX-10 | | 0.007 |
| HBS-1 | | 0.05 |
| gelatin | | 0.78 |
| The thirteenth layer (the third blue-sensitive emulsion layer) | | |
| Emulsion H | silver | 0.77 |
| Sensitizing Dye VIII | | $2.2 \times 10^{-4}$ |
| EX-9 | | 0.20 |
| HBS-1 | | 0.07 |
| gelatin | | 0.69 |
| The fourteenth layer (the first protective layer) | | |
| Emulsion I | silver | 0.5 |
| U-4 | | 0.11 |
| U-5 | | 0.17 |
| HBS-1 | | 0.05 |
| gelatin | | 1.00 |
| The fifteenth layer (the second protective layer) | | |
| polymethyl acrylate grains (diameter: about 1.5 μm) | | 0.54 |
| S-1 | | 0.20 |
| gelatin | | 1.20 |

Gelatin hardener H-1 and a surfactant were incorporated in each layer, in addition to the above-described components.

Sample A had a specific photographic sensitivity of 400.

| | Average AgI content (%) | Average particle diameter (μm) | Coefficient of variation of grain diameter (%) | Diameter/ thickness ratio | Silver amount ratio (AgI content %) |
|---|---|---|---|---|---|
| Lactic acid A | 4.3 | 0.45 | 27 | 1 | Core/intermediate/shell = 8/16/76/(0/27/0), grains having triple structure |
| Lactic acid B | 8.7 | 0.70 | 14 | 1 | Core/intermediate/shell = 8/16/76/(0/27/0), grains having triple structure |
| Lactic acid C | 10 | 0.75 | 30 | 2 | Core/shell = ½(24/3), grains having double structure |
| Lactic acid D | 16 | 1.05 | 35 | 2 | Core/shell = ½(40/0), grains having double structure |
| Lactic acid E | 10 | 1.05 | 35 | 3 | Core/shell = ½(24/3), grains having double structure |
| Lactic acid F | 4.3 | 0.25 | 28 | 1 | Core/intermediate/shell = 8/16/76/(0/27/0), grains having triple structure |
| Lactic acid G | 14 | 0.75 | 25 | 2 | Core/shell = ½(44/0), grains having double structure |
| Lactic acid H | 14 | 1.30 | 25 | 3 | Core/shell = ½(24/3), grains having double structure |
| Lactic acid I | 1 | 0.07 | 15 | 1 | |

EX-1

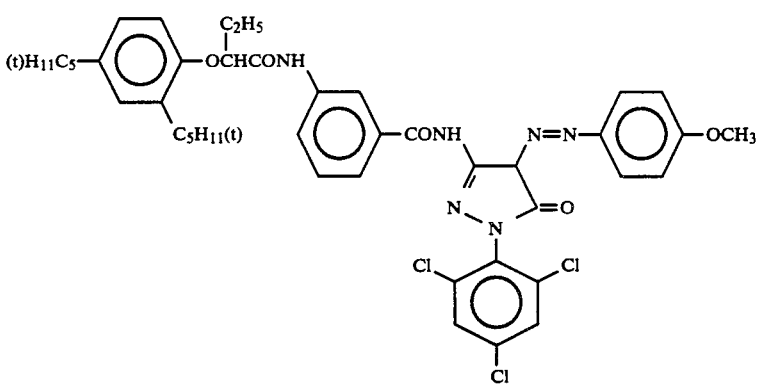

EX-2

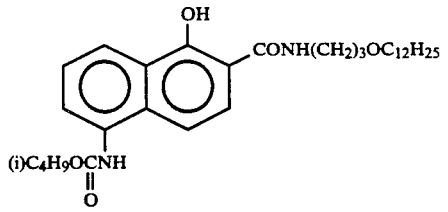

EX-3

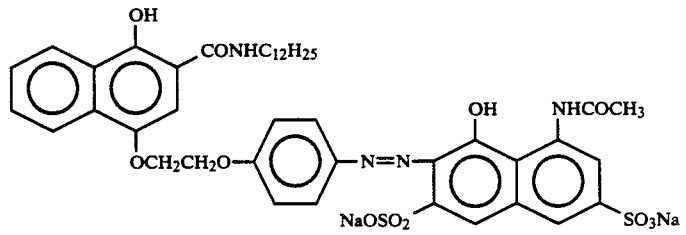

EX-4

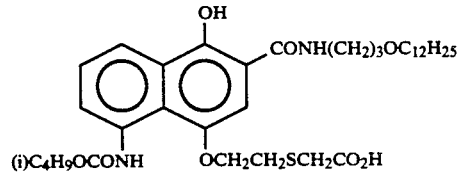

-continued
EX-5
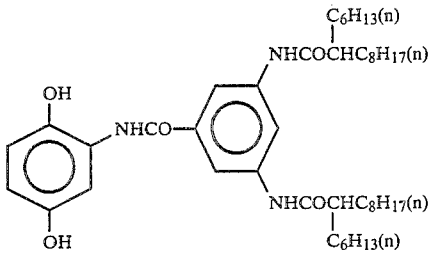
EX-6
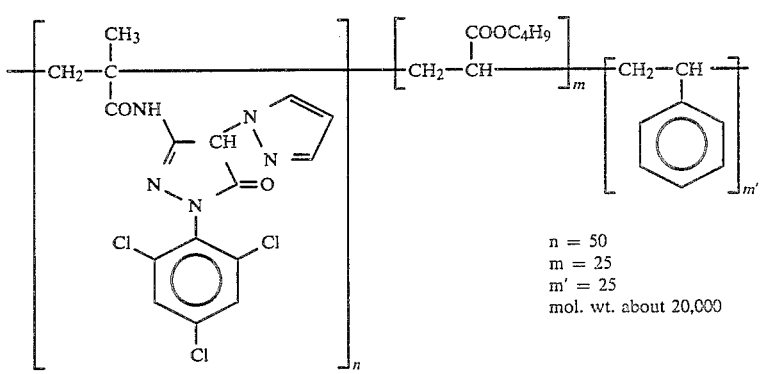
EX-7
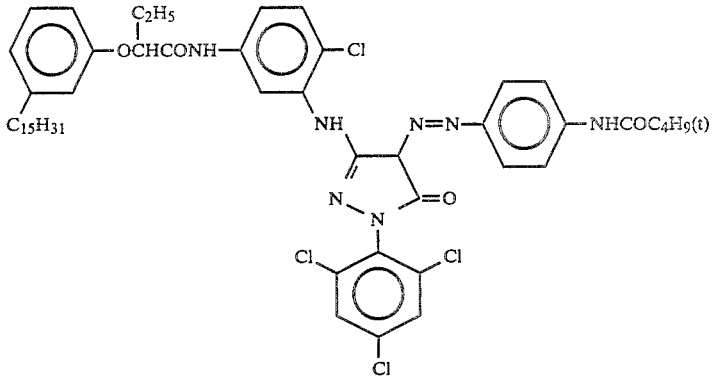
EX-8
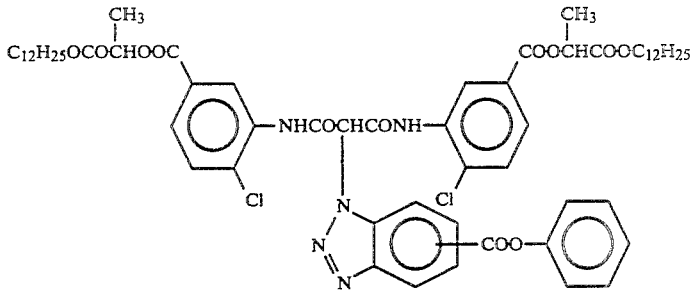
EX-9
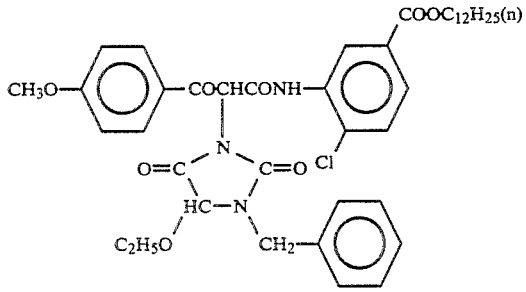

-continued
EX-10
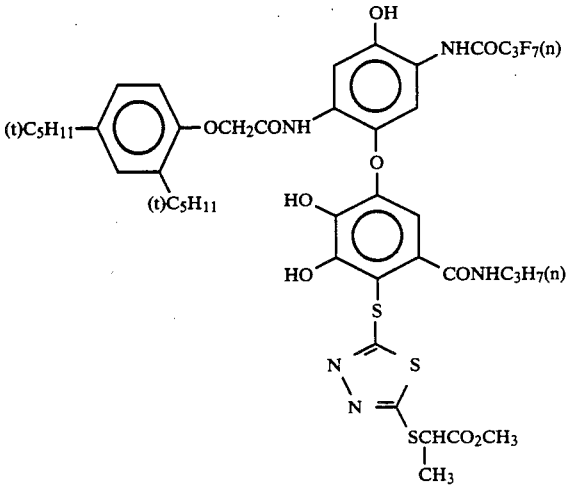
EX-11
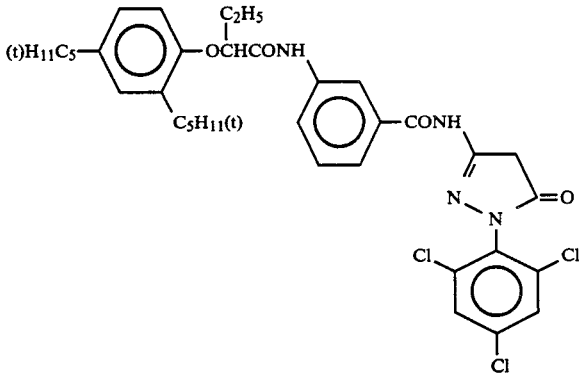
EX-12
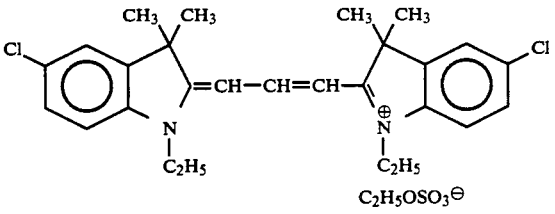
EX-13
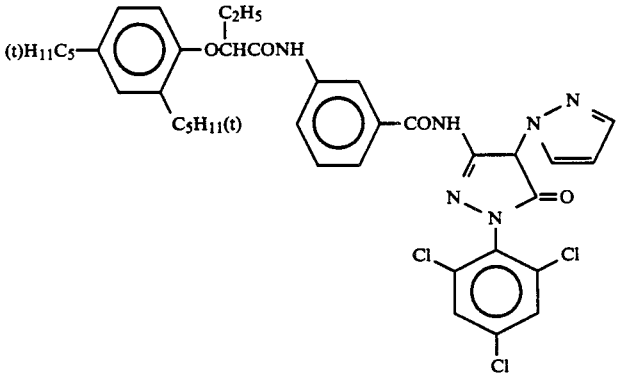
U-1
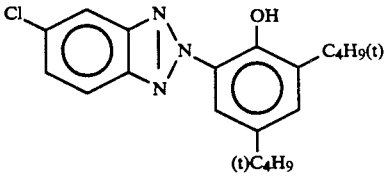

-continued
U-2
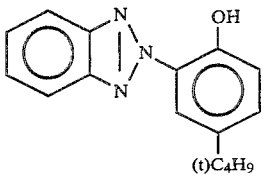
U-3
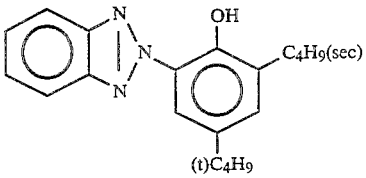
U-4
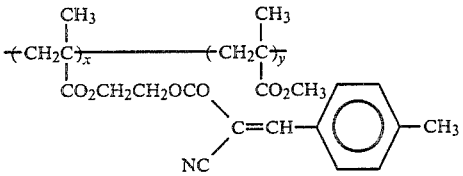
x:y = 70:30 (wt %)
UV-5
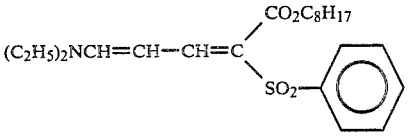
Tricresyl phosphate HBS-1
Di-n-butyl phthalate HBS-2
HBS-3
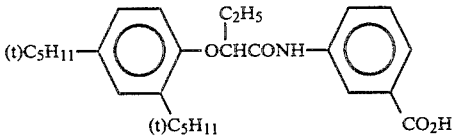
Sensitizing Dye I
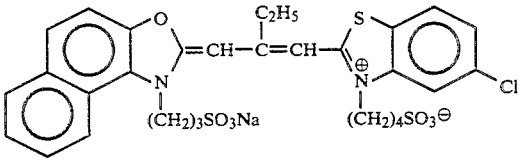
Sensitizing Dye II
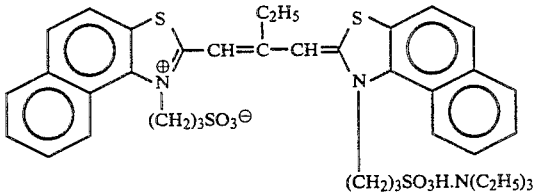
Sensitizing Dye III
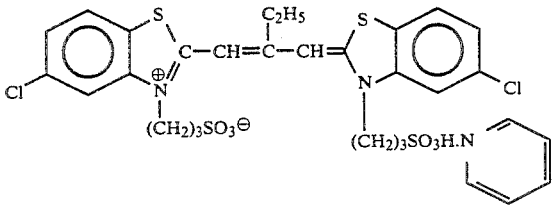

-continued

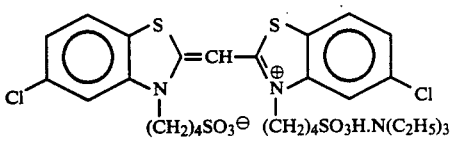

Sensitizing Dye VIII

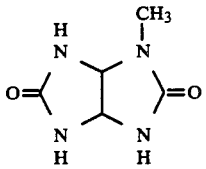

S-1

$CH_2{=}CH{-}SO_2{-}CH_2{-}CONH{-}CH_2$
$CH_2{=}CH{-}SO_2{-}CH_2{-}CONH{-}CH_2$

H-1

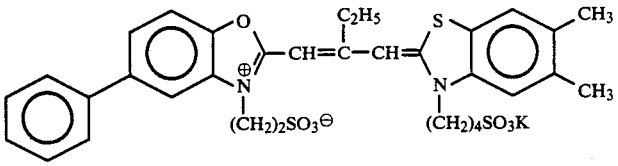

Sensitizing Dye V

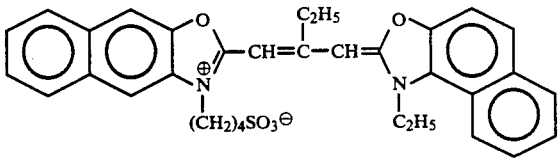

Sensitizing Dye VI

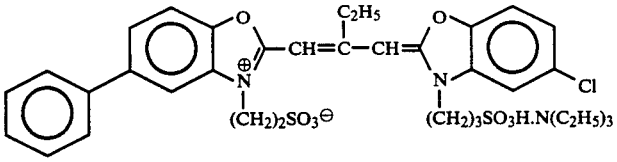

Sensitizing Dye VII

Figure 2:
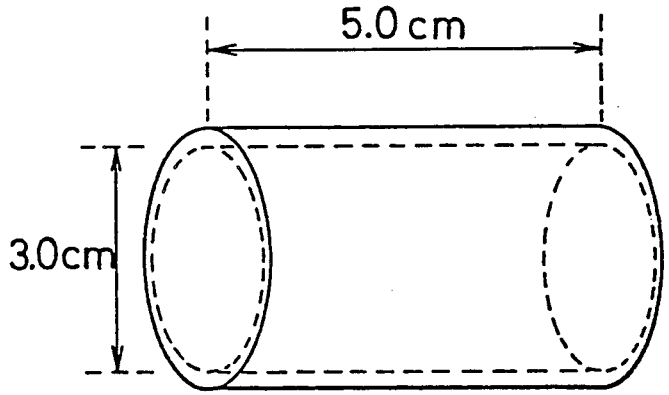
FIG. 2 is a schematic drawing of an ordinary polypropylene container for photographic film cartridge.
Figure 6:
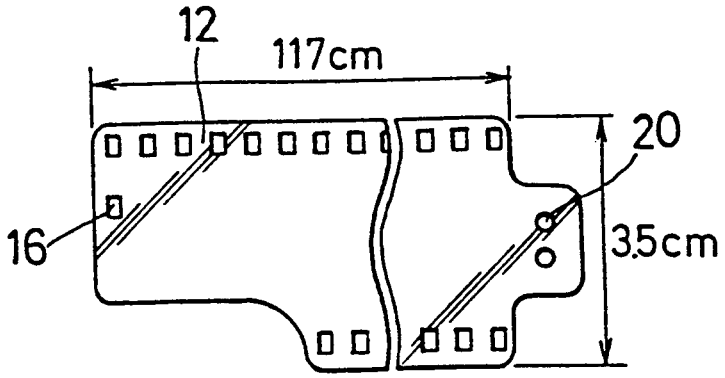
FIG. 6 is a plan of a photographic film strip, a part of which is omitted.

Sample A was cut to form a 35 mm roll film for 24 pictures as shown in FIG. 6, rolled in a patrone shown in FIG. 1 and then sealed in a P-case shown in FIG. 2 to form Sample 101.

Figure 5:
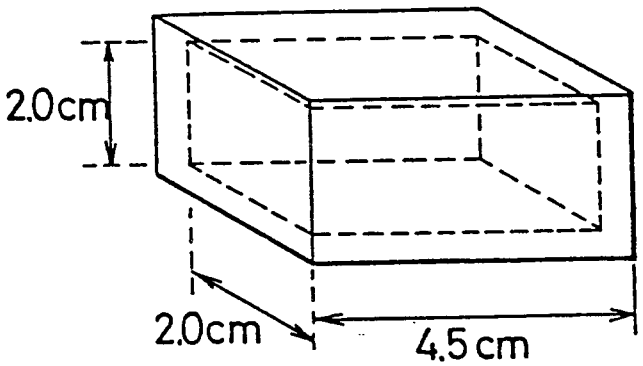

Sample A was cut into a 35 mm roll film for 24 pictures in the same manner as that of the formation of Sample 101. It was rolled and inserted into a miniaturized P-case as shown in FIG. 5 to form Sample 102. Since the thickness of the support was too great for the film to be rolled in a small patrone (FIG. 3) which will be described below, it was not placed in the patrone but inserted directly into the miniaturized P-case.

Figure 4:
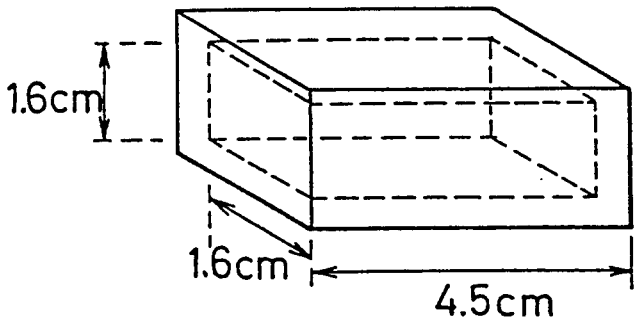
FIGS. 4 and 5 are schematic drawings of miniaturized container for photographic film cartridge.

Sample 103 was the same as Sample 102 except that the former was placed in the miniaturized P-case shown in FIG. 4.

Figure 3:
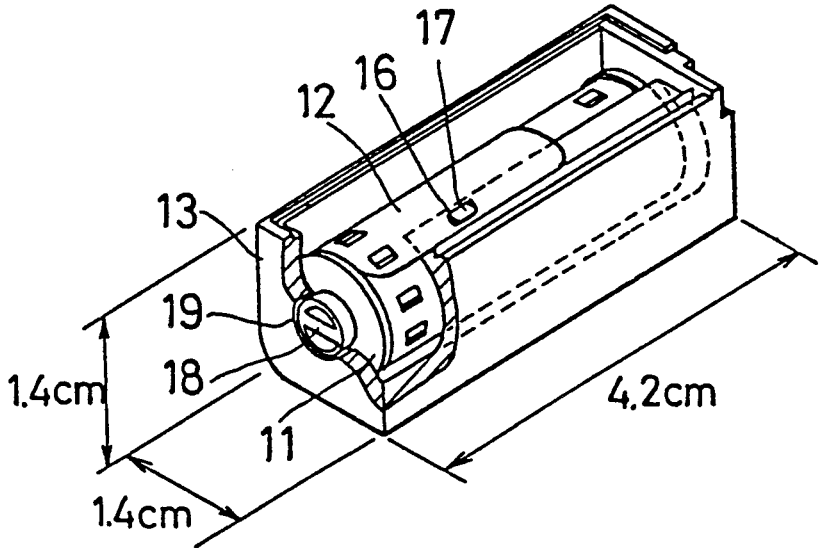
FIG. 3 is a perspective view of a miniaturized cartridge, a part of the body of which is cut off.

Sample B was prepared in the same manner as that in the preparation of Sample A except that the support was replaced with PET base having a water content of 0.7% prepared in the above-described Preparation Example (see Table A). Sample B was cut to form a 35 mm roll film for 24 pictures in the same manner as that of the formation of Sample 101. It was rolled in a small patrone as shown in FIG. 3. The patrone was placed in a small P-case shown in FIG. 4 to form Sample 104.

Samples 105 to 108 were prepared in the same manner as above except that the amounts of dimethyl 5-sodium sulfoisophthalate and adipic acid in the Preparation Example were varied to vary the water content of the support as shown in Table A.

Sample 110 was prepared by placing the 35 mm roll film for 24 pictures directly in the miniaturized P-case shown in FIG. 4. Namely, Sample 110 was the same as Sample 103 except that the former was not rolled in the small patrone.

Sample 109 was prepared in the same manner as that of Sample 104 except that the thickness of the PET base was changed to 60 μm.

All the samples were left to stand at room temperature at a relative humidity of 60% for two days, processed under the same temperature and humidity conditions and placed in P-cases.

Samples 101 to 110 were stored in the P-cases in a dark place at 60° C. for three days while the caps thereof were tightly fastened. They were then processed by the following method together with unheated samples:

| Step | Processing method Processing time | Processing temperature |
|---|---|---|
| Color development | 3 min 15 sec | 38° C. |
| Bleaching | 6 min 30 sec | 38° C. |
| Washing with water | 2 min 10 sec | 24° C. |
| Fixing | 4 min 20 sec | 38° C. |
| Washing with water (1) | 1 min 05 sec | 24° C. |
| Washing with water (2) | 2 min 10 sec | 24° C. |

-continued

| Step | Processing method Processing time | Processing temperature |
|---|---|---|
| Stabilization | 1 min 05 sec | 38° C. |
| Drying | 4 min 20 sec | 55° C. |

The compositions of the processing solutions were as follows:

(unit: g)

(Color developer)

| | | |
|---|---|---|
| diethylenetriaminepentaacetic acid | | 1.0 |
| 1-hydroxyethylidene-1,1-diphosphonic acid | | 3.0 |
| sodium sulfite | | 4.0 |
| potassium carbonate | | 30.0 |
| potassium bromide | | 1.4 |
| potassium iodide | | 1.5 mg |
| hydroxylamine sulfate | | 2.4 |
| 4-(N-ethyl-N-β-hydroxyethylamino)-2-methylaniline sulfate | | 4.5 |
| water | ad | 1.0 l |
| pH | | 10.05 |

(Bleaching solution)

| | | |
|---|---|---|
| sodium ferric ethylenediaminetetraacetate trihydrate | | 100.0 |
| disodium ethylenediaminetetraacetate | | 10.0 |
| ammonium bromide | | 140.0 |
| ammonium nitrate | | 30.0 |
| aqueous ammonia (27%) | | 6.5 ml |
| water | ad | 1.0 l |
| pH | | 6.0 |

(Fixing solution)

| | | |
|---|---|---|
| disodium ethylenediaminetetraacetate | | 0.5 |
| sodium sulfite | | 7.0 |
| sodium bisulfite | | 5.0 |
| aqueous ammonium thiosulfate solution (70%) | | 170.0 ml |
| water | ad | 1.0 l |
| pH | | 6.7 |

(Stabilizing solution)

| | | |
|---|---|---|
| formalin (37%) | | 2.0 ml |
| polyoxyethylene p-monononylphenyl ether (average degree of polymerization: 10) | | 0.3 |
| disodium ethylenediaminetetraacetate | | 0.05 |
| water | ad | 1.0 l |
| pH | | 5.0 to 8.0 |

The cyan, magenta and yellow fog densities of the processed films were determined. The difference (fogΔ) between the value of the heated sample and that of the unheated sample is shown in Table A.

It is apparent from Table A that when a base having a low water content is used, the photographic properties can be protected from impairment, while when a base having a high water content is used and the volume of the storing vessel is minimized, the photographic properties of the film are deteriorated at a high temperature as in a car in the sunlight to increase the fog. Namely, according to the present invention, a miniaturized cartridge can be used and, therefore, the camera can be miniaturized to improve case of carrying without impairing the storability.

It is apparent that the material of the miniaturized patrone per se does not affect the storability during storage from the fact that the photographic properties of Sample 104 are the same as those of Sample 110.

TABLE A

| Sample | Support: Material | Support: Thickness | Support: Water content (wt. %) | Area of photosensitive surface (X cm²) | Content volume of container (Y cm³) | Y/X | Fog Δ: Cyan density | Fog Δ: Magenta density | Fog Δ: Yellow density |
|---|---|---|---|---|---|---|---|---|---|
| 101 (Comp. Ex.) | Cellulose triacetate | 122μ | 2.5 | 373 | 35.3 | 0.095 | 0.15 | 0.16 | 0.20 |
| 102 (Comp. Ex.) | " | " | " | " | 18.0 | 0.048 | 0.20 | 0.23 | 0.31 |
| 103 (Comp. Ex.) | " | " | " | " | 11.5 | 0.031 | 0.22 | 0.25 | 0.33 |
| 104 (Present Invention) | PET (No. 2) | 80μ | 0.7 | " | " | " | 0.11 | 0.11 | 0.15 |
| 105 (Comp. Ex.) | PET (No. 5) | " | 1.8 | " | " | " | 0.18 | 0.19 | 0.28 |
| 106 (Present Invention) | PET (No. 4) | " | 1.3 | " | " | " | 0.14 | 0.15 | 0.18 |
| 107 (Present Invention) | PET (No. 3) | " | 1.0 | " | " | " | 0.12 | 0.12 | 0.16 |
| 108 (Comp. Ex.) | PET (No. 1) | " | 0.25 | " | " | " | * | * | * |
| 109 (Present Invention) | PET (No. 2) | 60μ | 0.7 | " | " | " | 0.10 | 0.11 | 0.15 |
| 110 (Present Invention) | PET (No. 2) | 80μ | 0.7 | " | " | " | 0.11 | 0.11 | 0.15 |

*The fog of Sample 108 could not be determined because of the curl of the film. PET No. is PET film No. given in the Preparation Example.

EXAMPLE 2

Sample C which was a multi-layered color photosensitive material composed of layers of the following compositions formed on a primed cellulose triacetate film support was prepared.

COMPOSITIONS OF THE PHOTOSENSITIVE LAYERS

The amounts of silver halides and colloidal silver were shown in terms of silver g/m², those of the coupler, additives and gelatin were shown in terms of g/m², the amount of gelatin was shown in terms of g/m² and those of the sensitizing dyes are shown in terms of the molar number per mol of the silver halide in the same layer. The symbols for the additives were as shown below. When the additive is usable for two or more purposes, only one of them is shown.

UV: ultraviolet ray absorber
Solv: high-boiling organic solvent
ExF: dye
ExS: sensitizing dye
ExC: cyan coupler
ExM: magenta coupler
ExY: yellow coupler
Cpd: additive The first layer (antihalation layer):

| | |
|---|---|
| black colloidal silver | 0.15 |
| gelatin | 2.9 |
| UV-1 | 0.03 |
| UV-2 | 0.06 |
| UV-3 | 0.07 |
| Solv-2 | 0.08 |
| ExF-1 | 0.01 |

-continued

| | | |
|---|---|---|
| ExF-2 | | 0.01 |

The second layer (red-sensitive emulsion layer having a low sensitivity)

| | | |
|---|---|---|
| silver bromoiodide emulsion (4 molar % of AgI, homogeneous AgI type; equivalent diameter of grain: 0.4 μm, coefficient of variation of the equivalent diameter of grain: 37%, diameter/thickness ratio of tabular grain: 3.0) | silver | 0.4 |
| gelatin | | 0.8 |
| ExS-1 | | $2.3 \times 10^{-4}$ |
| ExS-2 | | $1.4 \times 10^{-4}$ |
| ExS-5 | | $2.3 \times 10^{-4}$ |
| ExS-7 | | $8.0 \times 10^{-4}$ |
| ExC-1 | | 0.17 |
| ExC-2 | | 0.03 |
| ExC-3 | | 0.13 |

The third layer (red-sensitive emulsion layer having a medium sensitivity)

| | | |
|---|---|---|
| silver bromoiodide emulsion (AgI 6 molar %, internal high AgI type having core/shell ratio of 2:1, equivalent diameter of grain: 0.65 μm, coefficient of variation of the equivalent diameter of grain: 25%, diameter/- thickness ratio of tabular grain: 2.0) | silver | 0.65 |
| silver bromoiodide emulsion (AgI 4 molar %, homogeneous AgI type, equivalent diameter of grain: 0.4 μm, coefficient of variation of the equivalent diameter of grain: 37%, diameter/thickness ratio of tabular grain: 3.0) | silver | 0.1 |
| gelatin | | 1.0 |
| ExS-1 | | $2 \times 10^{-4}$ |
| ExS-2 | | $1.2 \times 10^{-4}$ |
| ExS-5 | | $2 \times 10^{-4}$ |
| ExS-7 | | $7 \times 10^{-6}$ |
| ExC-1 | | 0.31 |
| ExC-2 | | 0.01 |
| ExC-3 | | 0.06 |

The fourth layer (red-sensitive emulsion layer having a high sensitivity)

| | | |
|---|---|---|
| silver bromoiodide emulsion (AgI 6 molar % m internal high AgI type having core/shell ratio of 2:1, equivalent diameter of grain: 0.7 μm, coefficient of variation of the equivalent diameter of grain: 25%, diameter/thickness ratio of tabular grain: 2.5) | silver | 0.9 |
| gelatin | | 0.8 |
| ExS-1 | | $1.6 \times 10^{-4}$ |
| ExS-2 | | $1.6 \times 10^{-4}$ |
| ExS-5 | | $1.6 \times 10^{-4}$ |
| ExS-7 | | $6 \times 10^{-4}$ |
| ExC-1 | | 0.07 |
| ExC-4 | | 0.05 |
| Solv-1 | | 0.07 |
| Solv-2 | | 0.20 |
| Cpd-7 | | $4.6 \times 10^{-4}$ |

The fifth layer (intermediate layer)

| | | |
|---|---|---|
| gelatin | | 0.6 |
| UV-4 | | 0.03 |
| UV-5 | | 0.04 |
| Cpd-1 | | 0.1 |
| polyethyl acrylate latex | | 0.08 |
| Solv-1 | | 0.05 |

The sixth layer (green-sensitive emulsion layer having a low sensitivity)

| | | |
|---|---|---|
| silver bromoiodide emulsion (AgI 4 molar %, homogeneous AgI type, equivalent diameter of grain: 0.4 μm, coefficient of variation of the equivalent diameter of grain: 37% diameter/thickness ratio of tabular grain: 2.0) | silver | 0.18 |
| gelatin | | 0.4 |
| ExS-3 | | $2 \times 10^{-4}$ |
| ExS-4 | | $7 \times 10^{-4}$ |
| ExS-5 | | $1 \times 10^{-4}$ |
| ExM-5 | | 0.11 |
| ExM-7 | | 0.03 |
| ExY-8 | | 0.01 |
| Solv-1 | | 0.09 |
| Solv-4 | | 0.01 |

The seventh layer (green-sensitive emulsion layer having a medium sensitivity)

| | | |
|---|---|---|
| silver bromoiodide emulsion (AgI 4 molar %, surface high AgI type having core/shell ratio of 1:1, equivalent diameter of grain: 0.5 μm, coefficient of variation of the equivalent diameter of grain: 20%, diameter/thickness ratio of tabular grain: 4.0) | silver | 0.27 |
| gelatin | | 0.6 |
| ExS-3 | | $2 \times 10^{-4}$ |
| ExS-4 | | $7 \times 10^{-4}$ |
| ExS-5 | | $1 \times 10^{-4}$ |
| ExM-5 | | 0.17 |
| ExM-7 | | 0.04 |
| ExY-8 | | 0.02 |
| Solv-1 | | 0.14 |
| Solv-4 | | 0.02 |

The eighth layer (green-sensitive emulsion layer having a high sensitivity)

| | | |
|---|---|---|
| silver bromoiodide emulsion (AgI 8.7 molar %, grains of multilayer structure having silver amount ratio of 3:4:2, AgI contents: 24 molar % (inner layer), 0 molar % (intermediate layer) and 3 molar % (outer layer), equivalent diameter of grain: 0.7 μm, coefficient of variation of the equivalent diameter of grain: 25%, diameter/thickness ratio of tabular grain: 1.6) | silver | 0.7 |
| gelatin | | 0.8 |
| ExS-4 | | $5.2 \times 10^{-4}$ |
| ExS-5 | | $1 \times 10^{-4}$ |
| ExS-8 | | $0.3 \times 10^{-4}$ |
| ExM-5 | | 0.1 |
| ExM-6 | | 0.03 |
| ExY-8 | | 0.02 |
| ExC-1 | | 0.02 |
| ExC-4 | | 0.01 |
| Solv-1 | | 0.25 |
| Solv-2 | | 0.06 |
| Solv-4 | | 0.01 |
| Cpd-7 | | $1 \times 10^{-4}$ |

The ninth layer (intermediate layer)

| | | |
|---|---|---|
| gelatin | | 0.6 |
| Cpd-1 | | 0.04 |
| polyethyl acrylate latex | | 0.12 |
| Solv-1 | | 0.02 |

The tenth layer (donor layer having an interlayer effect on the red-sensitive layers)

| | | |
|---|---|---|
| silver bromoiodide emulsion (AgI 6 molar %, internal high AgI type having core/shell ratio of 2:1, equivalent diameter of grain: 0.7 μm, coefficient of variation of the equivalent diameter of grain: 25%, diameter/thickness ratio of tabular grain: 2.0) | silver | 0.68 |
| silver bromoiodide emulsion (AgI 4 molar %, homogeneous AgI type, equivalent diameter of grain: 0.4 μm, coefficient of variation of the equivalent diameter of grain: 37%, diameter/thickness ratio of tabular grain: 3.0) | silver | 0.19 |
| gelatin | | 1.0 |
| ExS-3 | | $6 \times 10^{-4}$ |
| ExM-10 | | 0.19 |
| Solv-1 | | 0.20 |

-continued

| | | |
|---|---|---|
| **The eleventh layer (yellow filter layer)** | | |
| yellow colloidal silver | | 0.06 |
| gelatin | | 0.8 |
| Cpd-2 | | 0.13 |
| Solv-1 | | 0.13 |
| Cpd-1 | | 0.07 |
| Cpd-6 | | 0.002 |
| H-1 | | 0.13 |
| **The twelfth layer (blue-sensitive emulsion layer having low sensitivity)** | | |
| silver bromoiodide emulsion (AgI 4.5 molar %, homogeneous AgI type, equivalent diameter of grain: 0.7 μm, coefficient of variation of the equivalent diameter of grain: 15%, diameter/thickness ratio of tabular grain: 7.0) | silver | 0.3 |
| silver bromoiodide emulsion (AgI 3 molar %, homogeneous AgI type, equivalent diameter of grain: 0.3 μm, coefficient of variation of the equivalent diameter of grain: 30%, diameter/thickness ratio of tabular grain: 7.0) | silver | 0.15 |
| gelatin | | 1.8 |
| ExS-6 | | $9 \times 10^{-4}$ |
| ExC-1 | | 0.06 |
| ExC-4 | | 0.03 |
| ExY-9 | | 0.14 |
| ExY-11 | | 0.89 |
| Solv-1 | | 0.42 |
| **The thirteenth layer (intermediate layer)** | | |
| gelatin | | 0.7 |
| ExY-12 | | 0.20 |
| Solv-1 | | 0.34 |
| **The fourteenth layer (blue-sensitive emulsion layer having high sensitivity)** | | |
| silver bromoiodide emulsion (AgI 10 molar %, internal high AgI type, equivalent diameter of grain: 1.0 μm, coefficient of variation of the equivalent diameter of grain: 25%, diameter/thickness ratio of multi-twin tabular grains: 2.0) | silver | 0.5 |
| gelatin | | 0.5 |
| ExS-6 | | $1 \times 10^{-4}$ |
| ExY-9 | | 0.01 |
| ExY-11 | | 0.20 |
| ExC-1 | | 0.02 |
| Solv-1 | | 0.10 |
| **The fifteenth layer (the first protective layer)** | | |
| emulsion of fine silver bromoiodide grains (AgI 2 molar %, homogeneous AgI type, equivalent diameter of grain: 0.07 μm) | silver | 0.12 |
| gelatin | | 0.9 |
| UV-4 | | 0.11 |
| UV-5 | | 0.16 |
| Solv-5 | | 0.02 |
| H-1 | | 0.13 |
| Cpd-5 | | 0.10 |
| polyethyl acrylate latex | | 0.09 |
| **The sixteenth layer (the second protective layera)** | | |
| emulsion of fine silver bromoiodide grains (AgI 2 molar %, homogeneous AgI type, equivalent diameter of grain: 0.07 μm) | silver | 0.36 |
| gelatin | | 0.55 |
| polymethyl methacrylate grains (diameter: 1.5 μm) | | 0.2 |
| H-1 | | 0.17 |

0.07 g/m$^2$ of Cpd-3 as the stabilizer for the emulsion and 0.03 g/m$^2$ of Cpd-4 as the surfactant were incorporated as coating assistants in each layer, in addition to the above-described components.

Sample C had a specific photographic sensitivity of 100.

UV-1

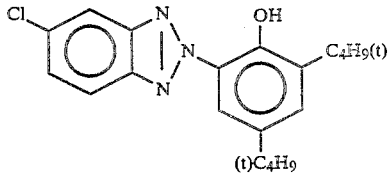

UV-2

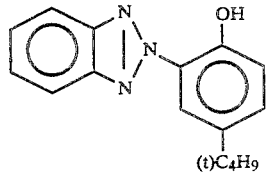

UV-3

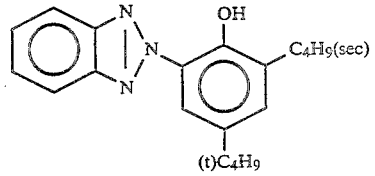

-continued
UV-4
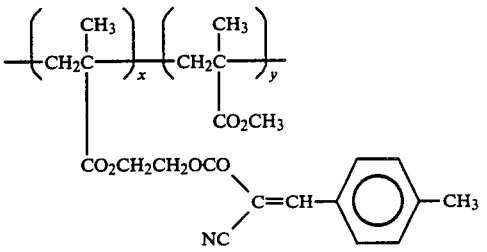
x:y = 70:30 (wt %)
UV-5
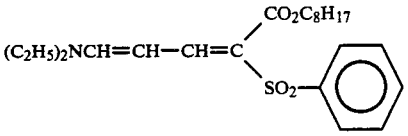
Tricresyl phosphate — Solv-1
Dibutyl phthalate — Solv-2
Solv-4
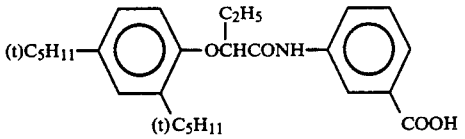
Trihexyl phosphate — Solv-5
ExF-1
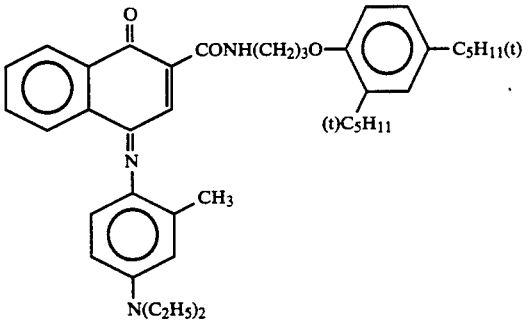
ExF-2
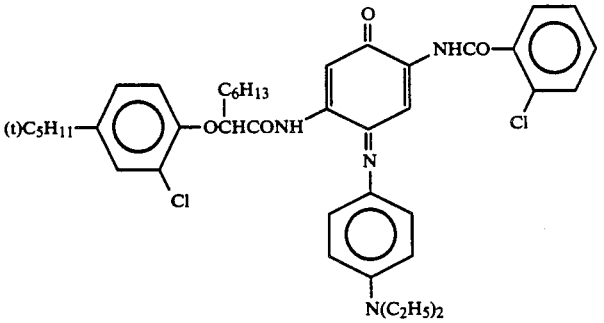
ExS-1
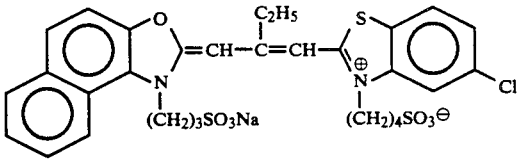

-continued
ExS-2
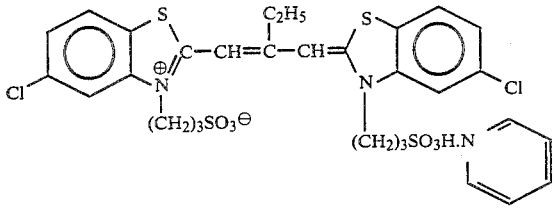
ExS-3
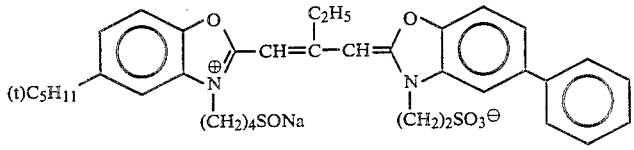
ExS-4
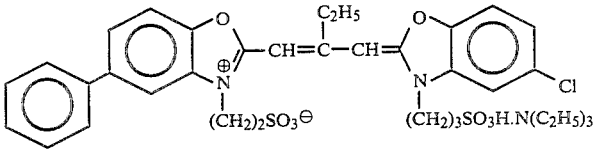
ExS-5
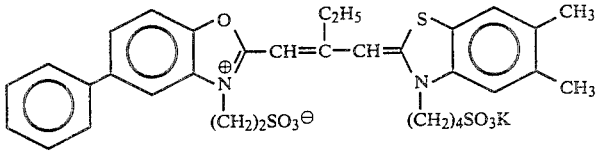
ExS-6
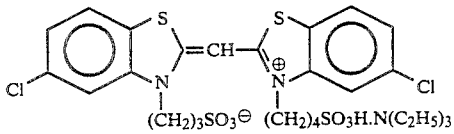
ExS-7
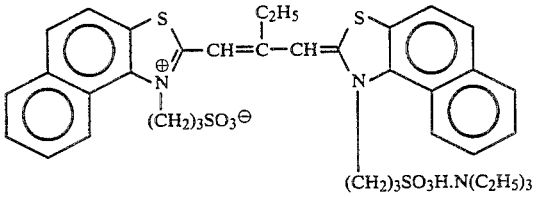
ExS-8
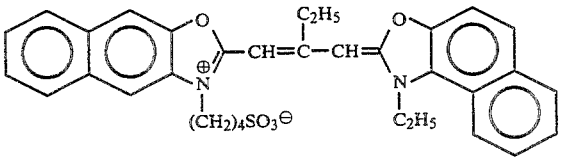
ExC-1
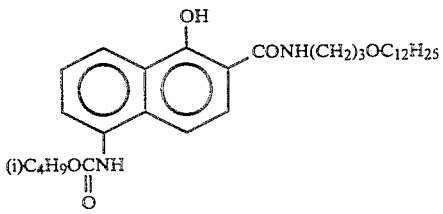

-continued
ExC-2
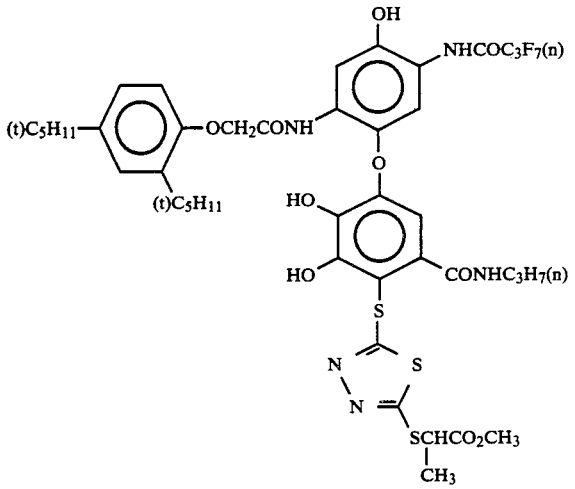
ExC-3
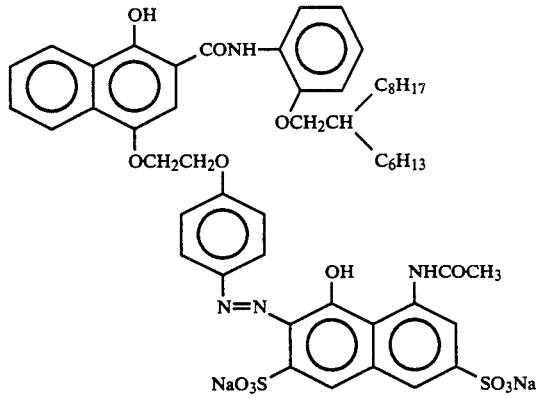
ExC-4
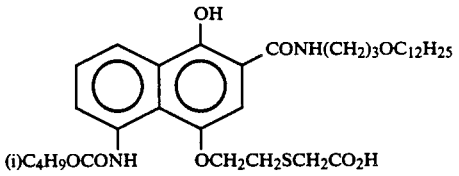
ExM-5
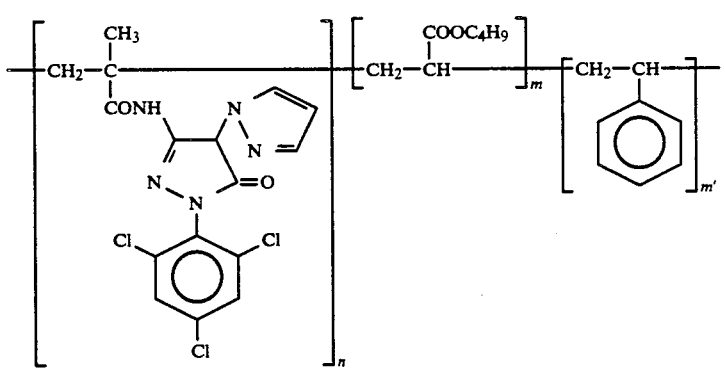
n = 50
m = 25
m' = 25
mol. wt. about 20,000

-continued
ExM-6
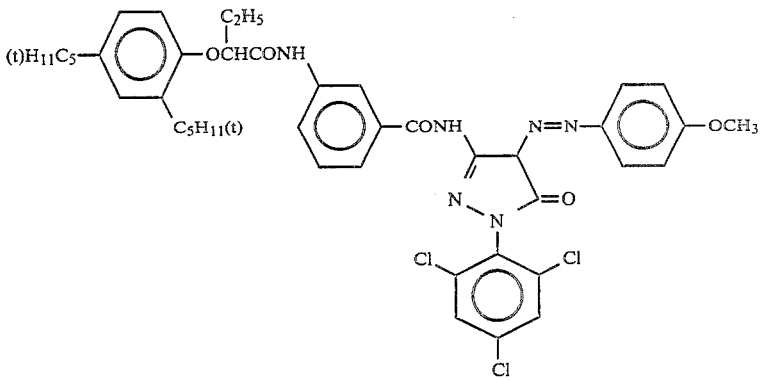
ExM-7
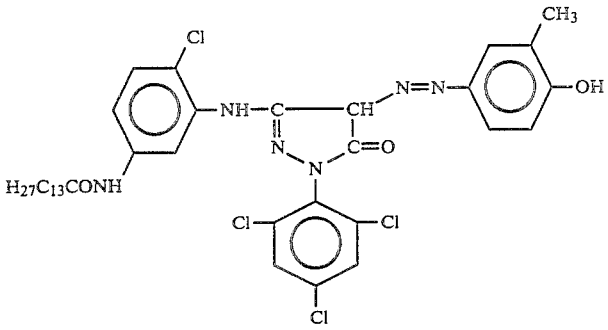
ExM-10
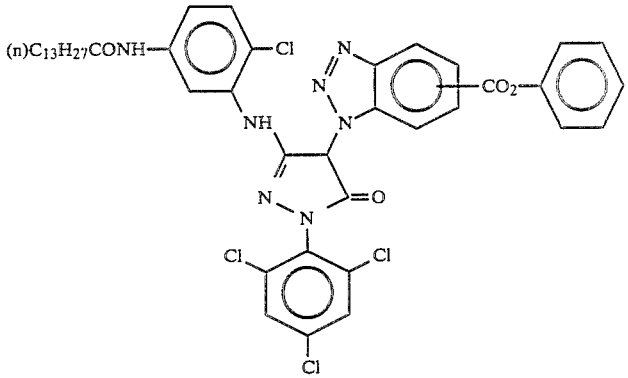
ExY-8
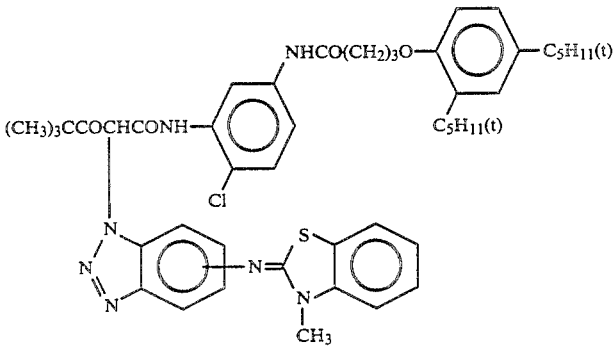

-continued
ExY-9
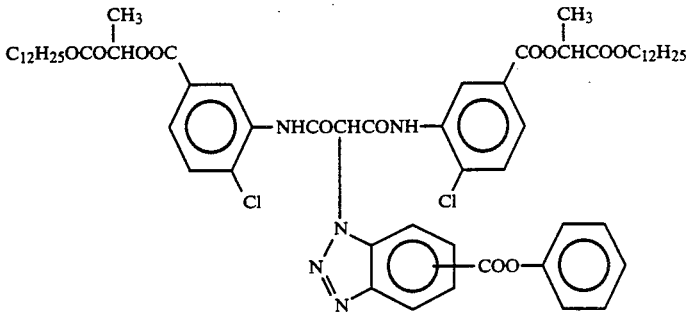
ExY-11
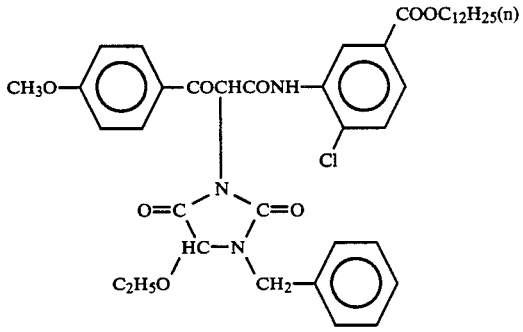
ExY-12
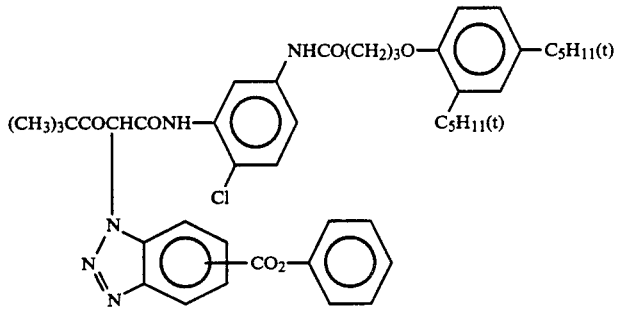
Cpd-7
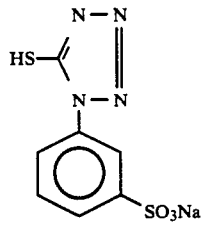
Cpd-1
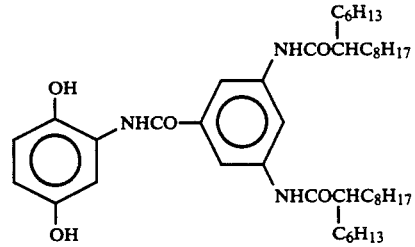
Cpd-2
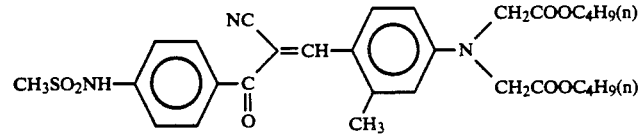

-continued

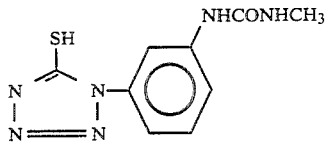

Cpd-6

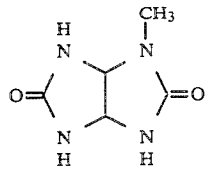

Cpd-5

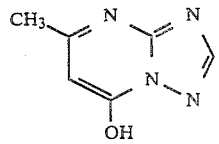

Cpd-3

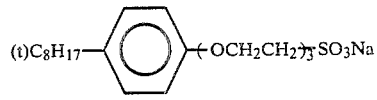

Cpd-4

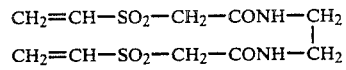

H-1

Sample C was cut to form a 35 mm roll film for 24 pictures as shown in FIG. 6 and then rolled in the patrone as shown in FIG. 1. It was placed in the P-case as shown in FIG. 2 to form Sample 201.

Sample C was cut into a 35 mm roll film for 24 pictures in the same manner as that of the formation of Sample 201. It was rolled and placed in the miniaturized P-case as shown in FIG. 5 in the same manner as in the formation of Sample 102 in Example 1 to form Sample 202.

Sample 203 was the same as Sample 202 except that the former was placed in the miniaturized P-case shown in FIG. 4.

Sample D was prepared in the same manner as that in the preparation of Sample C except that the support was replaced with PET base having a water content of 0.7% prepared in the above-described Preparation Example (see table B). Sample D was cut to form a 35 mm roll film for 24 pictures in the same manner as that of the formation of Sample 201. It was rolled in the small patrone as shown in FIG. 3. The patrone was placed in the same P-case shown in FIG. 4 to form Sample 204.

Samples 205 to 208 were prepared in the same manner as above except that the amounts of dimethyl 5-sodium sulfoisophthalate and adipic acid in the Preparation Example were varied to vary the water content of the support as shown in Table B.

Sample 209 was prepared in the same manner as that of Sample 204 except that the thickness of the PET base was changed to 60 μm.

All the samples were left to stand at room temperature at a relative humidity of 60% for two days, processed under the same temperature and humidity conditions and placed in P-cases.

Samples 201 to 209 were heated and processed and the densities were determined in the same manner as that of Example 1 to obtain the results shown in Table B.

It is apparent also from Table B that when a base having a low water content is used, the increase of the fog can be inhibited, while when a base having a high water content is used, the fog is seriously increased during the storage at a high temperature in the miniaturized container.

TABLE B

| | Support | | | Area of photosensitive surface | Content Volume of container | | Fog Δ | | |
|---|---|---|---|---|---|---|---|---|---|
| Sample | Material | Thickness | Water content (wt. %) | (X cm²) | (Y cm³) | Y/X | Cyan density | Magenta density | Yellow density |
| 201 (Comp. Ex.) | Cellulose triacetate | 122μ | 2.5 | 373 | 35.3 | 0.095 | 0.09 | 0.04 | 0.07 |
| 202 (Comp. Ex.) | " | " | " | " | 18.0 | 0.048 | 0.14 | 0.07 | 0.09 |
| 203 (Comp. Ex.) | " | " | " | " | 11.5 | 0.031 | 0.16 | 0.07 | 0.10 |
| 204 (Present Invention) | PET (No. 2) | 80μ | 0.7 | " | " | " | 0.05 | 0.02 | 0.04 |
| 205 (Comp. Ex.) | PET (No. 5) | " | 1.8 | " | " | " | 0.09 | 0.05 | 0.08 |
| 206 (Present Invention) | PET (No. 4) | " | 1.3 | " | " | " | 0.06 | 0.02 | 0.05 |
| 207 (Present Invention) | PET (No. 3) | " | 1.0 | " | " | " | 0.05 | 0.02 | 0.04 |
| 208 (Comp. Ex.) | PET (No. 1) | " | 0.25 | " | " | " | * | * | * |
| 209 (Present | PET (No. 2) | 60μ | 0.7 | " | " | " | 0.04 | 0.02 | 0.04 |

TABLE B-continued

| Sample | Support Material | Support Thickness | Support Water content (wt. %) | Area of photosensitive surface (X cm²) | Content Volume of container (Y cm³) | Y/X | Fog Δ Cyan density | Fog Δ Magenta density | Fog Δ Yellow density |
|---|---|---|---|---|---|---|---|---|---|
| Invention) | | | | | | | | | |

*The fog of Sample 208 could not be determined because of the curl of the film. PET No. is PET film No. given in the Preparation Example.

What is claimed:

1. A package of photosensitive material which comprises a sealed container containing a silver halide photosensitive material comprising a transparent synthetic resin support having at least one photosensitive silver halide emulsion layer formed thereon, the support having a water content of 0.3 to 1.5% by weight and the content volume of the sealed container being $0.08\times cm^3$ or less when the area of one surface of the photosensitive material is $\times cm^2$.

2. A package of photosensitive material of claim 1 wherein the support has a water content of 0.3 to 1.0% by weight.

3. A package of photosensitive material of claim 1 wherein the support is a cellulose triacetate film.

4. A package of photosensitive material of claim 1 wherein the support is a polyester film.

5. A package of photosensitive material of claim 4 wherein the polyester film is one prepared by using an aromatic dicarboxylic acid component having a metal sulfonate as a copolymerizable component.

6. A package of photosensitive material of claim 5 wherein the aromatic dicarboxylic acid component is used in an amount of 2 to 15 mol %.

7. A package of photosensitive material of claim 1 wherein the support has a thickness of 30 to 85 μm.

8. A package of photosensitive material of claim 4 wherein the polyester film has a film haze of 3% or less, breaking strength of 8 to 25 kg/mm², initial modulus of 200 to 500 kg/mm² and a tear strength of at least 30 g in case of film thickness of 120 μm.

9. A package of photosensitive material of claim 1 wherein a prime layer is formed on the support and the prime layer is prepared by using a polymer latex comprising a styrene/butadiene copolymer or vinylidene chloride copolymer or a hydrophilic binder.

10. A package of photosensitive material of claim 1 wherein the content volume of the sealed container is $0.05\times cm^3$ to $0.01\times cm^3$.

11. A package of photosensitive material of claim 1 wherein the photosensitive material has a specific photosensitive of at least 100.

* * * * *